US005768654A

United States Patent [19]

Noguchi et al.

[11] Patent Number: 5,768,654

[45] Date of Patent: Jun. 16, 1998

[54] IMAGE FORMING APPARATUS WITH FIXING TEMPERATURE CONTROL

[75] Inventors: Akio Noguchi, Ebina; Hakaru Muto, Yokohama; Eihiro Sakaki, Chofu, all of Japan

[73] Assignee: Canon Kabushiki Kaisha, Tokyo, Japan

[21] Appl. No.: 649,338

[22] Filed: May 17, 1996

Related U.S. Application Data

[63] Continuation of Ser. No. 217,877, Mar. 25, 1994, abandoned.

[30] Foreign Application Priority Data

| | | | |
|---|---|---|---|
| Mar. 26, 1993 | [JP] | Japan | 5-067205 |
| Apr. 5, 1993 | [JP] | Japan | 5-101910 |
| Apr. 15, 1993 | [JP] | Japan | 5-111217 |

[51] Int. Cl.[6] ..... G03G 15/20

[52] U.S. Cl. ..... 399/69; 219/216; 399/70

[58] Field of Search ..... 355/282, 285, 355/289, 290, 203–209; 219/216, 469–471; 399/67, 69, 70

[56] References Cited

U.S. PATENT DOCUMENTS

| | | | |
|---|---|---|---|
| 4,373,801 | 2/1983 | Itoh | 355/285 |
| 4,719,489 | 1/1988 | Ohkubo et al. | 219/216 X |
| 4,822,977 | 4/1989 | Leising et al. | 219/216 |
| 5,073,799 | 12/1991 | Watanabe | 355/285 |
| 5,138,392 | 8/1992 | Kinoshita et al. | 355/289 |
| 5,274,402 | 12/1993 | Serizawa et al. . | |
| 5,319,426 | 6/1994 | Baruch et al. | 355/285 |
| 5,321,481 | 6/1994 | Mathers | 355/290 |
| 5,361,124 | 11/1994 | Rowe et al. | 355/208 |

*Primary Examiner*—William J. Royer

*Attorney, Agent, or Firm*—Fitzpatrick, Cella, Harper & Scinto

[57] ABSTRACT

An image forming apparatus has a fixing device for fixing an image formed on a recording medium, a device for detecting an operating environment of the image forming apparatus, a selecting device for selecting a fixing device temperature in accordance with a detection result, and a control device for controlling the temperature of the fixing device to a selected fixing device temperature. The image forming apparatus is capable of efficiently bringing out the functions of a print engine thereof at a minimum cost without the need for adding a new high-speed device, achieving a higher printing speed and ensuring a good fixing property regardless of the thickness of paper used, while preventing wasteful energy consumption and adverse influences by heat.

16 Claims, 36 Drawing Sheets

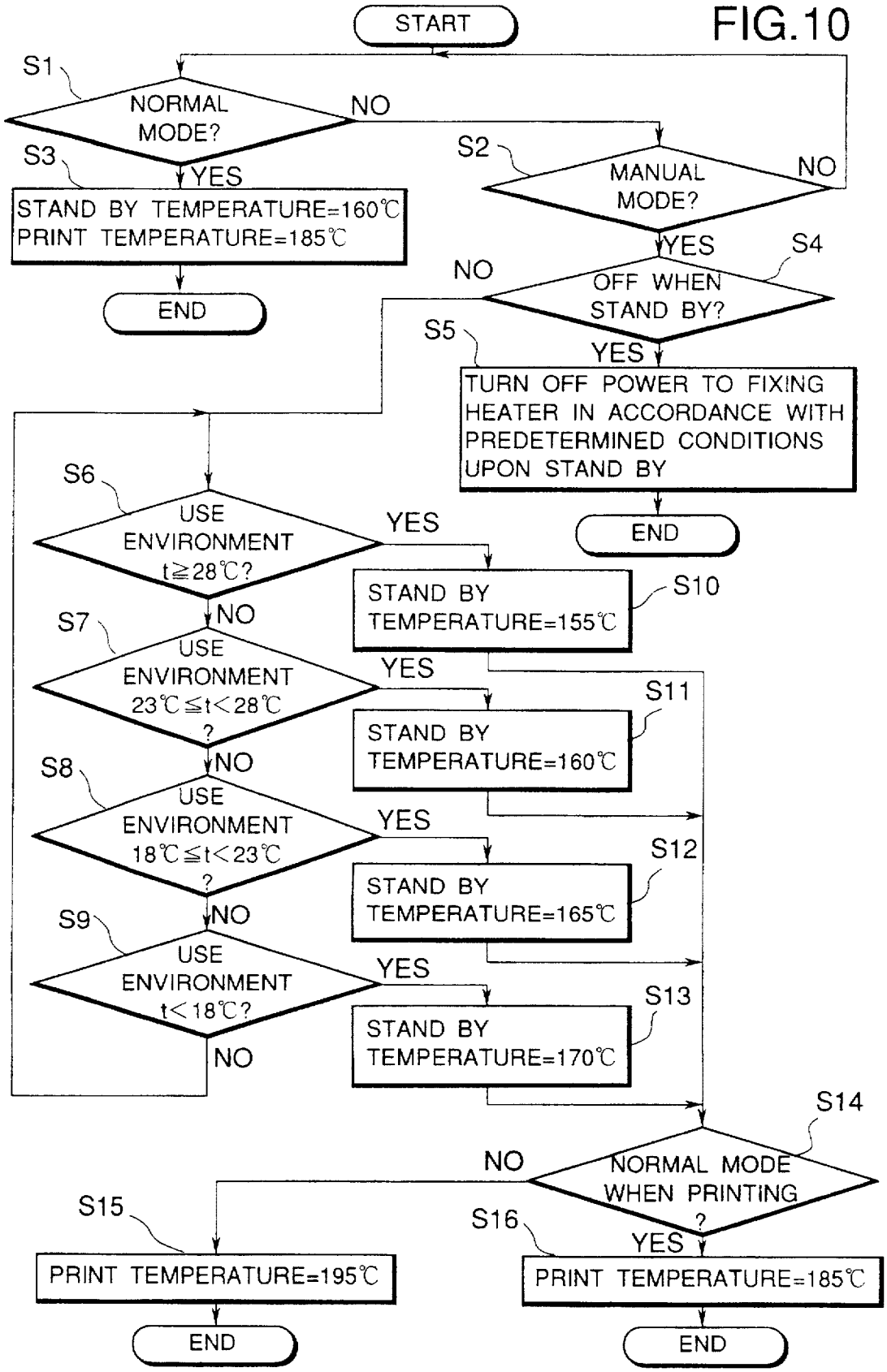
FIG.10
START
S1
NORMAL MODE?
NO
YES
S2
MANUAL MODE?
NO
YES
S3
STAND BY TEMPERATURE=160℃
PRINT TEMPERATURE=185℃
END
S4
OFF WHEN STAND BY?
NO
YES
S5
TURN OFF POWER TO FIXING HEATER IN ACCORDANCE WITH PREDETERMINED CONDITIONS UPON STAND BY
END
S6
USE ENVIRONMENT t≧28℃?
YES
NO
S10
STAND BY TEMPERATURE=155℃
S7
USE ENVIRONMENT 23℃≦t<28℃ ?
YES
NO
S11
STAND BY TEMPERATURE=160℃
S8
USE ENVIRONMENT 18℃≦t<23℃ ?
YES
NO
S12
STAND BY TEMPERATURE=165℃
S9
USE ENVIRONMENT t<18℃?
YES
NO
S13
STAND BY TEMPERATURE=170℃
S14
NORMAL MODE WHEN PRINTING ?
NO
YES
S15
PRINT TEMPERATURE=195℃
END
S16
PRINT TEMPERATURE=185℃
END

FIG.11

| COMMAND ABBREVIATION | CODE | FUNCTION | RETURN STATUS |
|---|---|---|---|
| SR 0 | 01H | STATUS 0 REQUEST | STATUS 0 |
| SR 1 | 02H | STATUS 1 REQUEST | STATUS 1 |
| SR 2 | 04H | STATUS 2 REQUEST | STATUS 2 |
| SR 4 | 08H | STATUS 4 REQUEST | STATUS 4 |
| SR 5 | 0BH | STATUS 5 REQUEST | STATUS 5 |
| SR 15 | 1FH | STATUS 15 REQUEST | STATUS 15 |
| EC 0 | 40H | DESIGNATE EXTERNAL EQUIPMENT AS OUTPUT SIDE OF $\overline{\text{SCLK}}$ SIGNAL | STATUS 0 |
| EC 1 | 43H | DESIGNATE PRINTER AS OUTPUT SIDE OF $\overline{\text{SCLK}}$ SIGNAL | STATUS 0 |
| EC 2 | 45H | INDICATE REST | STATUS 0 |
| EC 3 | 46H | INDICATE RELEASE OF REST | STATUS 0 |
| EC 6 | 4CH | DESIGNATE CASSETTE PAPER FEEDING | STATUS 0 |
| EC 7 | 4FH | DESIGNATE MANUAL INSERTION PAPER FEEDING | STATUS 0 |
| EC 14 | 5DH | INDICATE RELEASE OF DATA RETURN REQUEST | STATUS 0 |
| EEC 62 | 93H<br>××H | DESIGNATE TEMPERATURE CONTROL METHOD OF FIXING DEVICE | STATUS 0<br>STATUS 0 |

FIG.14

| | |
|---|---|
| 1st bit (MSB) | 0 |
| 2nd bit | NORMAL MODE (PRINT TEMPERATURE=185℃ STAND BY TEMPERATURE=160℃) |
| 3rd bit | MANUAL MODE |
| 4th bit | SET TEMPERATURE UPON STAND BY, USING TWO BITS, 4th/5th BITS |
| 5th bit | |
| 6th bit | 0 |
| 7th bit | 1 : PRINT TEMPERATURE=195℃<br>0 : PRINT TEMPERATURE=185℃ |
| 8th bit (LSB) | ODD PARITY |

FIG.15

| ENVIRONMENTAL TEMPERATURE | 4th bit | 5th bit | STAND BY TEMPERATURE |
|---|---|---|---|
| t≧28℃ | 0 | 0 | 155℃ |
| 23℃≦t<28℃ | 0 | 1 | 160℃ |
| 18℃≦t<23℃ | 1 | 0 | 165℃ |
| t<18℃ | 1 | 1 | 170℃ |

FIG.17

| | |
|---|---|
| 1st bit (MSB) | 0 |
| 2nd bit | NORMAL MODE (PRINT TEMPERATURE=185℃ STAND BY TEMPERATURE=160℃) |
| 3rd bit | MANUAL MODE |
| 4th bit | MANUAL MODE SET USING TWO BITS, 4th/5th BITS |
| 5th bit | |
| 6th bit | 0 |
| 7th bit | MANUAL MODE, FIX PRINT TEMPERATURE |
| 8th bit (LSB) | ODD PARITY |

FIG.18

| ENVIRONMENTAL TEMPERATURE | 4th bit | 5th bit | STAND BY TEMPERATURE | PRINT TEMPERATURE |
|---|---|---|---|---|
| t≧28℃ | 0 | 0 | 155℃ | 185℃ |
| 23℃≦t<28℃ | 0 | 1 | 160℃ | 190℃ |
| 18℃≦t<23℃ | 1 | 0 | 165℃ | 195℃ |
| t<18℃ | 1 | 1 | 170℃ | 200℃ |

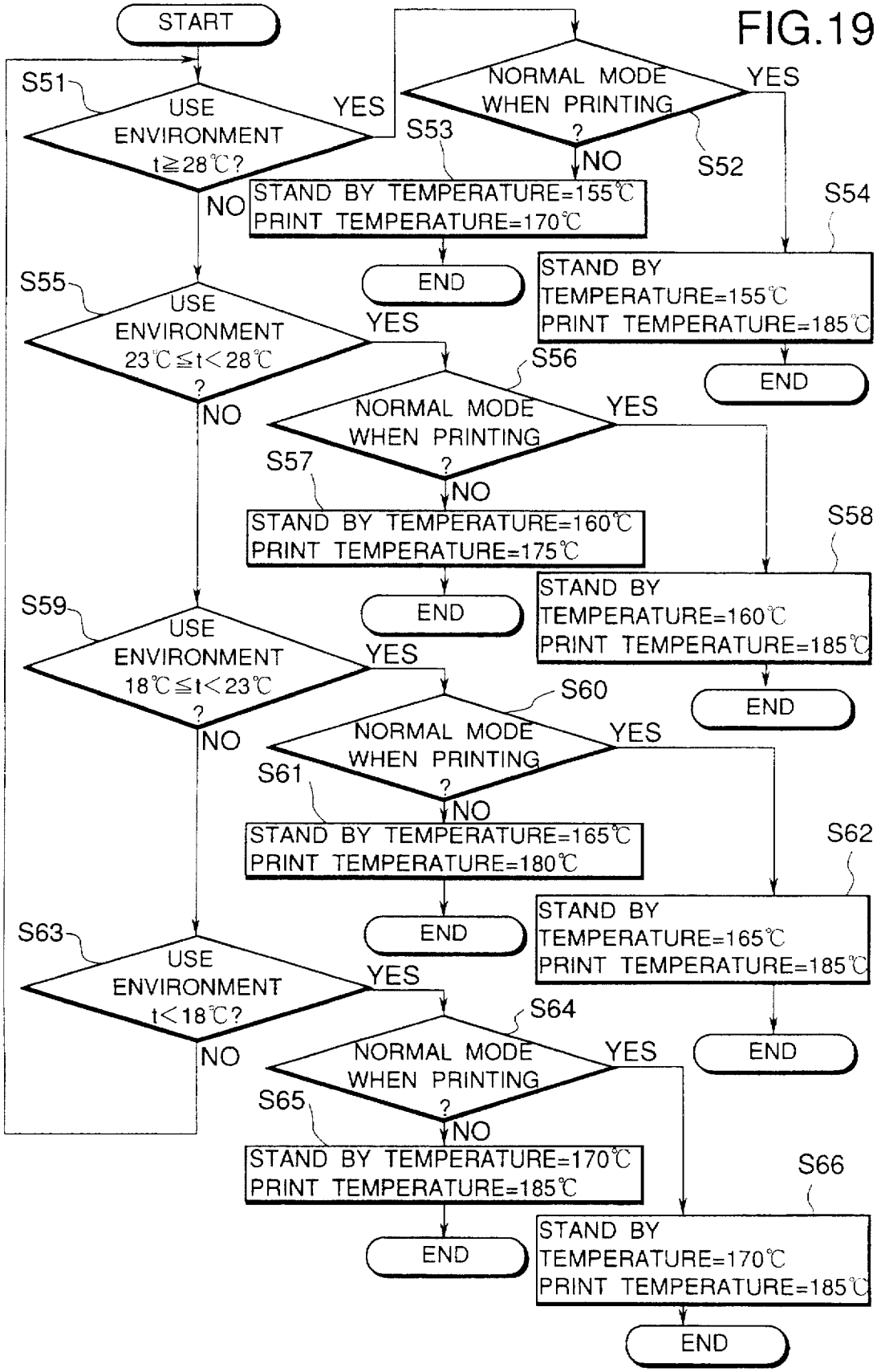
FIG.19
START
S51
USE ENVIRONMENT t≧28℃?
YES
NO
NORMAL MODE WHEN PRINTING ?
YES
NO
S52
S53
STAND BY TEMPERATURE=155℃
PRINT TEMPERATURE=170℃
END
S54
STAND BY TEMPERATURE=155℃
PRINT TEMPERATURE=185℃
END
S55
USE ENVIRONMENT 23℃≦t<28℃ ?
YES
NO
S56
NORMAL MODE WHEN PRINTING ?
YES
NO
S57
STAND BY TEMPERATURE=160℃
PRINT TEMPERATURE=175℃
END
S58
STAND BY TEMPERATURE=160℃
PRINT TEMPERATURE=185℃
END
S59
USE ENVIRONMENT 18℃≦t<23℃ ?
YES
NO
S60
NORMAL MODE WHEN PRINTING ?
YES
NO
S61
STAND BY TEMPERATURE=165℃
PRINT TEMPERATURE=180℃
END
S62
STAND BY TEMPERATURE=165℃
PRINT TEMPERATURE=185℃
END
S63
USE ENVIRONMENT t<18℃?
YES
NO
S64
NORMAL MODE WHEN PRINTING ?
YES
NO
S65
STAND BY TEMPERATURE=170℃
PRINT TEMPERATURE=185℃
END
S66
STAND BY TEMPERATURE=170℃
PRINT TEMPERATURE=185℃
END

FIG.21

| COMMAND | CODE | FUNCTION | RETURN STATUS |
|---|---|---|---|
| SR 0 | 01H | STATUS 0 REQUEST | STATUS 0 |
| SR 1 | 02H | STATUS 1 REQUEST | STATUS 1 |
| SR 2 | 04H | STATUS 2 REQUEST | STATUS 2 |
| SR 4 | 08H | STATUS 4 REQUEST | STATUS 4 |
| SR 5 | 0BH | STATUS 5 REQUEST | STATUS 5 |
| SR 15 | 1FH | STATUS 15 REQUEST | STATUS 15 |
| EC 0 | 40H | DESIGNATE EXTERNAL EQUIPMENT AS OUTPUT SIDE OF $\overline{\text{SCLK}}$ SIGNAL | STATUS 0 |
| EC 1 | 43H | DESIGNATE PRINTER AS OUTPUT SIDE OF $\overline{\text{SCLK}}$ SIGNAL | STATUS 0 |
| EC 2 | 45H | INDICATE REST | STATUS 0 |
| EC 3 | 46H | INDICATE RELEASE OF REST | STATUS 0 |
| EC 6 | 4CH | DESIGNATE CASSETTE PAPER FEEDING | STATUS 0 |
| EC 7 | 4FH | DESIGNATE MANUAL INSERTION PAPER FEEDING | STATUS 0 |
| EC 14 | 5DH | INDICATE RELEASE OF DATA RETURN REQUEST | STATUS 0 |
| EEC 64 | 95H<br>××H | DESIGNATE TEMPERATURE CONTROL METHOD OF FIXING DEVICE | STATUS 0<br>STATUS 0 |

FIG.22

| | |
|---|---|
| 1st bit (MSB) | 0 |
| 2nd bit | 1 : NORMAL MODE (185℃) |
| 3rd bit | 1 : MANUAL MODE (195℃) |
| 4th bit | 0 |
| 5th bit | 0 |
| 6th bit | 0 |
| 7th bit | 0 |
| 8th bit (LSB) | ODD PARITY |

IMAGE FORMING APPARATUS WITH FIXING TEMPERATURE CONTROL

This application is a continuation of application Ser. No. 08/217,877, filed Mar. 25, 1994 now abandoned.

BACKGROUND OF THE INVENTION

1. Field of the Invention

The present invention relates to an image forming apparatus which has a heat fixing device.

2. Related Background Art

Conventionally, in an image forming apparatus based on an electrophotographic method, temperature control is performed under univocal temperature setting by means of a preset heat fixing temperature. More specifically, under a low-temperature environmental condition to a high-temperature environmental condition, a temperature range, which covers thick recording paper to thin recording paper, is univocally set to perform temperature control. In addition, control is performed to cut off electric power supplied to a fixing heater to save energy of the apparatus during a standby period.

And in the fixing temperature control in the aforesaid conventional image forming apparatus, a printer engine control unit transmits a driving signal to a control unit of a fixing device which includes a fixing roller to perform control at a univocally set fixing temperature. This fixing roller is provided with a thermistor for detecting temperature, and fixing temperature information is supplied to the control unit of the printer engine in terms of a control signal received from the control unit of the fixing device. As a result, as described above, a temperature set value, which is common to all recording media or environmental temperatures, is univocally set as the fixing temperature.

The aforesaid conventional image forming apparatus, however, poses a problem in that a fixing property deteriorates especially when thick paper such as proper bond paper is used as the recording paper under the low-temperature environment. And if, by way of experiment, the fixing temperature is raised to cover a range for such a type of paper, then mechanism elements of the fixing device will be adversely affected by heat under the high-temperature environment, presenting a problem in that the temperature control is restricted.

Therefore, to solve those problems, efforts have been made to maintain image quality by preparing a control unit which incorporates a special control system designed to raise the fixing temperature on the assumption that a recording apparatus is used with thick paper or under a low-temperature environment.

Raising the fixing temperature, however, consumes wasteful energy when the recording apparatus is used with thin recording paper or under a high-temperature environment, causing a problem from a standpoint of a temperature rise in the apparatus and energy saving.

FIG. 1 is an example of a flowchart which shows an operation in the temperature control.

First, a current printer control state is determined; if the printer is printing (400), then a target voltage Vref is switched to V2 (402); and if the printer is not printing, i.e., if it is in a standby state (400), then the target voltage Vref is switched to V1 (401).

Next, if a voltage Vt to be applied has not yet reached the target voltage Vref (404), then a halogen heater or the like in a fixing roller is turned ON (406); or if it has reached the target voltage Vref (404), then the halogen heater is turned OFF (405).

FIG. 2 is an explanatory drawing which shows a change in the temperature of a heating roller.

In the drawing, T1 is a target temperature for a non-printing mode and it corresponds to the voltage V1 mentioned above. Likewise, T2 is the target temperature for a printing mode and it corresponds to the voltage V2 mentioned above. More specifically, as shown in the drawing, there are two types, namely, T1 (V1) and T2 (V2), of a temperature target (target voltage) value which is set targeted for a lower temperature than an actual fixing temperature (standby temperature) during a non-printing period to reduce electric power consumption of the printer and to prevent the roller from deteriorating. During printing, a predetermined fixing temperature is set for the target temperature.

FIG. 3 is a block diagram which shows a connection state of a recording apparatus 2, which has the aforesaid heat fixing roller type fixing device, and a host computer 1, which transmits print data to the recording apparatus 2.

In the drawing, the recording apparatus 2 outputs an unfixed image under an electrophotographic process based on, for example, a laser beam printer, to carry out fixing by using the aforesaid fixing apparatus. S1 is a communication line; it is used to transmit print data to the recording apparatus 1 and also to send and receive diverse data to and from the recording apparatus. The print data transmitted via the communication line S1 are code data.

An image developing apparatus 3 develops an image according to the print data transmitted from the host computer 1 and outputs bit serial data S2. S5 is a PRINT signal; it is a signal which instructs a printer engine unit 4 to start print control. The printer engine unit 4 performs print control according to the bit serial data S2.

S3 is a READY signal; it is a signal which reports to the image developing apparatus 3 that the printer engine unit 4 is ready for printing. For the READY signal S3 to become true, many requirements must be satisfied in the printer engine unit 4, some of such requirements being no recording paper left in the equipment and the temperature of the fixing device having reached a predetermined temperature. To simplify the explanation, however, only the temperature of the fixing device will be discussed hereinafter and description will be presented on the assumption that all other requirements are satisfied.

FIG. 4 is a flowchart which shows an operation performed from the moment the image developing apparatus 3 receives the print data from the host computer 1 of the recording apparatus 2.

In the image developing apparatus 3, the transfer of print data from the host computer 1 is completed (501); therefore, the print data is held in a memory which is not shown (500). When the transfer of the print data is completed (501), all print data are developed into bit serial data (502), and upon completion of the development (503), the PRINT signal (S5) is transmitted to the printer engine unit 4 (504).

When the printer engine unit 4 receives the PRINT signal, it starts the control for reaching the fixing temperature T2, and as soon as the fixing temperature T2 is reached, it outputs the READY signal S3 to the image developing apparatus 3. The image developing apparatus 3 waits for the READY signal S3 to be issued (505), then outputs in sequence the bit serial signal S2 in synchronization with a synchronizing signal, not shown, received from the printer engine unit 4 (506).

FIGS. 5(*a*)–(*f*) represent a timing chart which shows a relationship between the data transfer and the temperature control.

In the drawing, t1 is a time required for the host computer to complete transferring the print data to the recording apparatus 2 via the communication line S1, and t2 is a time required for the image developing apparatus 3 to complete the development into the bit serial data. Further, t3 is a time required for the PRINT signal (S5) to be transmitted to the printer engine unit 4, and t4 is a time required for the fixing temperature to reach T2 and the READY signal (S3) to be issued. Furthermore, t5 is the time required for printing to be completed and t6 is the time required for the temperature to reach the fixing temperature T2 from the standby temperature T1.

In the conventional apparatus described above, however, as shown in FIG. 5, it takes t5 from the moment the host computer 1 sends out the print data to the moment the recording apparatus 2 completes printing. In particular, the time T6 required for the temperature control of the printer engine is significantly prolonged depending on the setting of T1, causing a great difficulty in increasing printing speed. To solve the problem, countermeasures such as employing a high-speed device for the image developing apparatus to increase a processing speed thereof have been taken, but this has resulted in considerably increased cost.

SUMMARY OF THE INVENTION

It is an object of the present invention to solve the problem with the prior art described above.

It is another object of the present invention to provide a recording apparatus which is capable of making efficient use of a print engine function at minimum cost without adding a new high-speed device and also of providing a printing speed which is higher than that in the past.

It is still another object of the present invention to solve various problems with the recording apparatus which is designed to allow the fixing temperature of the fixing device to be changed.

To fulfill the objects described above, the present invention provides an image forming apparatus, wherein, according to code information received from an external apparatus, the code information is converted to dot data and the dot data are recorded into a recording medium by an electrophotographic method, the apparatus comprising a means for detecting a use environment of the apparatus, a means for generating selective information of a fixing temperature in accordance with a result of the detection, and a means for selecting a predetermined fixing temperature among preset fixing temperatures for a use environment of the apparatus, thereby fixing an image at the selected fixing temperature.

Further, according to the present invention, a fixing temperature, which has been set through a fixing temperature setting means of an external apparatus, can be changed to a different fixing temperature under a predetermined condition.

The predetermined condition is preferably the detection of the removal of a cassette, which houses a recording medium, or the detection of no paper.

It is a further object of the present invention to provide an image forming apparatus which is capable of solving the problem described above and exhibiting a good fixing property with all recording papers from thick to thin paper while preventing adverse influences exerted by heat and wasteful energy consumption.

According to the present invention, when image data, a request for starting image formation, and specification of the fixing temperature are entered in the form of code information from an external apparatus such as the host computer, an image controller transmits data as dot data and commands, which are necessary for forming an image, to the engine control unit via a video interface communication means in accordance with the information. This causes the engine control unit to switch the fixing temperature to either a normal fixing temperature or a temperature which is higher than the normal fixing temperature in accordance with the commands and to control an image forming operation while carrying out the temperature control over the fixing device. For instance, when thick recording paper is used, specifying the fixing temperature, which is higher than the normal fixing temperature, through the aforesaid external apparatus causes the fixing operation to be performed at a high temperature, making it possible to supply an adequate quantity of heat even with the thick recording paper, thus enabling a good image to be obtained. Maintaining, however, such a high fixing temperature over an extended time may cause adverse influences exerted by heat. The present invention, therefore, controls the occurrence of such adverse influences by switching to the normal fixing temperature by a command via the video interface communication means under a predetermined condition when the fixing operation is carried out at the fixing temperature which is higher than the normal fixing temperature as in this case. For example, the fixing temperature is immediately set back to the normal fixing temperature under a predetermined condition wherein the fixing operation at the high fixing temperature mentioned above has been completed.

Furthermore, according to the present invention, the temperature control is carried out at one of the fixing temperatures by the engine control unit, and at the time of the fixing operation, the control unit measures and stores an energizing time necessary for maintaining the fixing temperature for a heating means of the fixing apparatus, then it waits for a subsequent request for starting the image formation. And when the next image formation is begun, the energizing time is measured again and the new measured time is compared with the previous measured time. If these measured times are different, then the control unit switches to the fixing temperature to a proper level.

According to the present invention, the recording apparatus, which has a heating element maintained at a predetermined temperature and which heats an image on a recording material by using heat from the heating element to produce a copy image, further has a temperature control means, which maintains the heating element at the predetermined temperature, an image generating means for generating image data on the recording material, and an instructing means for instructing the temperature control means to begin control without waiting for the completion of the generation of the image data by the image generating means, thus performing constant-temperature control at a predetermined temperature in accordance with an instruction given by the instructing means.

This prevents a fixing process from being carried out at a fixing temperature which is not suited to a use environment including a recording medium.

Other objects, advantages, and effects will become more apparent from the following detailed description, attached drawings, and claims.

BRIEF DESCRIPTION OF THE DRAWINGS

FIG. 10 is a flowchart which shows a procedure for the fixing temperature control in the apparatus associated with the embodiment;

FIG. 11 is a diagram which shows a table of commands for the video interface;

FIG. 14 is a diagram which shows the details of command data in the video interface;

FIG. 15 is a diagram which shows the details of the command data in the video interface;

FIG. 17 is a diagram which shows command data of a video interface in Embodiment 2;

FIG. 18 is a diagram which shows the command data of the video interface in Embodiment 2;

FIG. 19 is a flowchart which shows a temperature setting operation in an apparatus associated with Embodiment 3;

FIG. 21 is a diagram which shows a table of commands in a video interface in Embodiment 4;

FIG. 22 is a diagram which shows the details of command data in the video interface communication means of FIG. 4;

[EMBODIMENT 1]

The following presents detailed explanation of a preferred embodiment, namely, Embodiment 1 in accordance with the present invention with reference to the attached drawings.

Figure 6:
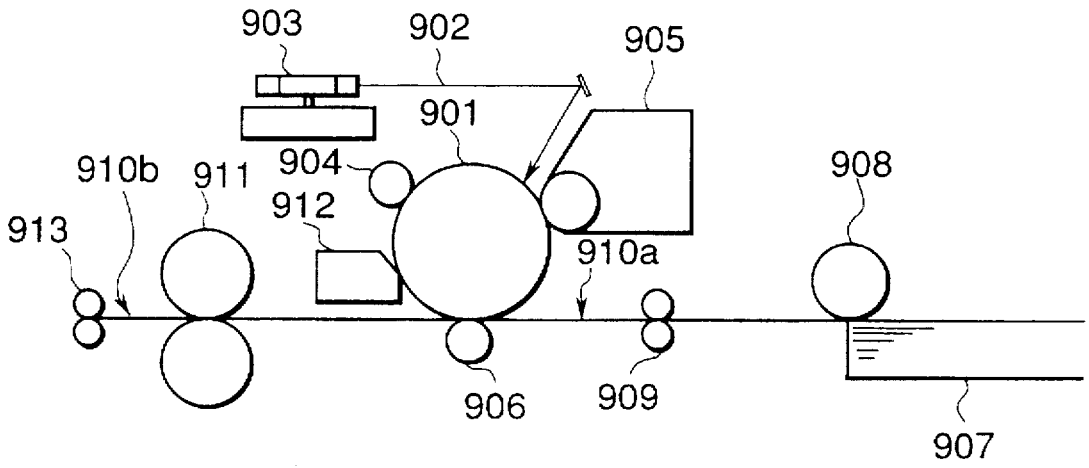
FIG. 6 is a schematic cross-sectional configuration diagram of the image forming apparatus associated with an embodiment of the present invention.

FIG. 6 is the schematic cross-sectional configuration diagram of the image forming apparatus associated with the embodiment of the present invention. In this case, a laser beam printer, for example, is assumed as the image forming apparatus.

In FIG. 6, a reference numeral 901 is a photosensitive drum for forming an electrostatic latent image, 902 is a laser beam which turns ON and OFF in accordance with received image information, 903 is a rotary polygon mirror which scans the laser beam 902 over the photosensitive drum 901, 904 is a charging roller for charging the photosensitive drum 901 uniformly, and 905 is a developing device which develops the electrostatic latent image formed by the laser beam 902.

Further, 906 is a transfer roller for transferring a toner image formed on the photosensitive drum 901, 907 is a paper cassette, 908 is a paper feed roller for picking up paper from the paper cassette 907, 909 is a resist roller for correcting crooked run of paper by applying a leading edge of the paper against itself and also for synchronizing the timing of writing an image to the photosensitive drum 901 with the transport of the paper, 910*a* and 910*b* are paper presence sensors for detecting the presence of paper, 911 is a fixing roller for fusing the toner, which has been transferred to the paper, onto the paper, and 912 is a cleaner which collects the toner remaining on the photosensitive drum 901. And 913 is a paper eject roller.

Figure 7:
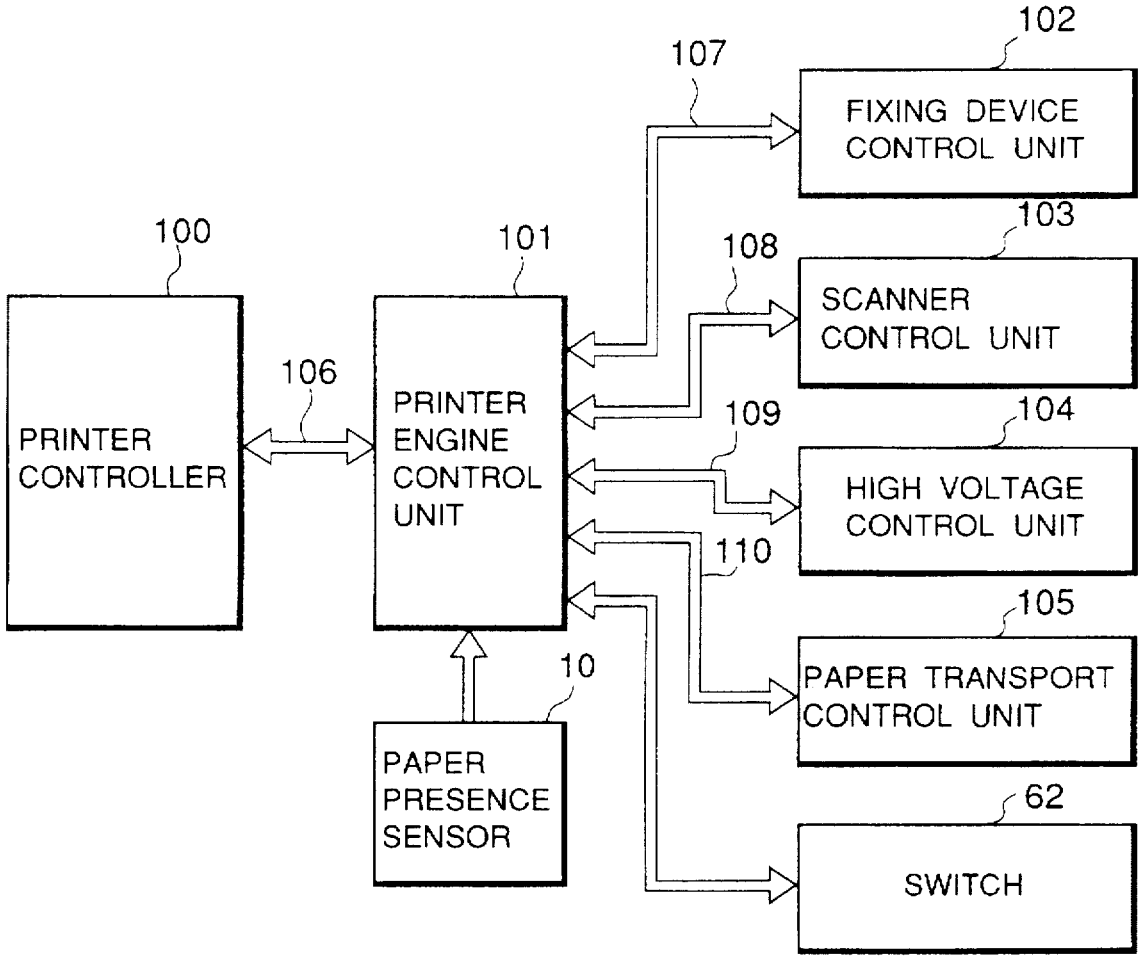
FIG. 7 is a block diagram which shows a control configuration of the image forming apparatus associated with the embodiment.

FIG. 7 is the block diagram which shows the control configuration for the image forming apparatus shown in FIG. 6. In the drawing, 100 is a printer controller which enables communication with a printer engine control unit 101 via a vide interface 106. Further, 102 is a fixing device control unit which controls the drive of the fixing roller 911 in accordance with a control signal 107 received from the printer engine control unit 101.

103 is a scanner control unit which controls the drive of the polygon mirror 903 in accordance with a control signal 108 received from the printer engine control unit 101. 104 is a high voltage control unit which controls high voltage applied to the transfer roller 906, the developing device 905, the charging roller 904, etc. in accordance with a control signal 109 received from the printer engine control unit 101. Furthermore, 105 is a paper transport control unit which controls the drive of the paper feed roller 908, the resist roller 909, the paper eject roller 913, etc. in accordance with a control signal 110 from the printer engine control unit 101.

A basic operation of the laser beam printer, which has the configuration described above, will now be discussed.

When the printer controller 100 sends a ready signal RDY to an external host computer (not shown), it waits until a printer request signal PRINT is issued. When the print request signal PRINT is received, the paper feed roller 908 is driven to start paper feed. At this time, when the paper presence sensor 910*a* detects the leading edge of the fed paper, a vertical synchronization request signal VSREQ in a subscanning direction is notified to the printer controller 100 at a predetermined timing.

Upon receipt of the report, the printer controller 100 immediately sends a vertical synchronizing signal VSYNC to the printer engine control unit 101, thereby driving a semiconductor laser in accordance with image information VDO.

Figure 1:
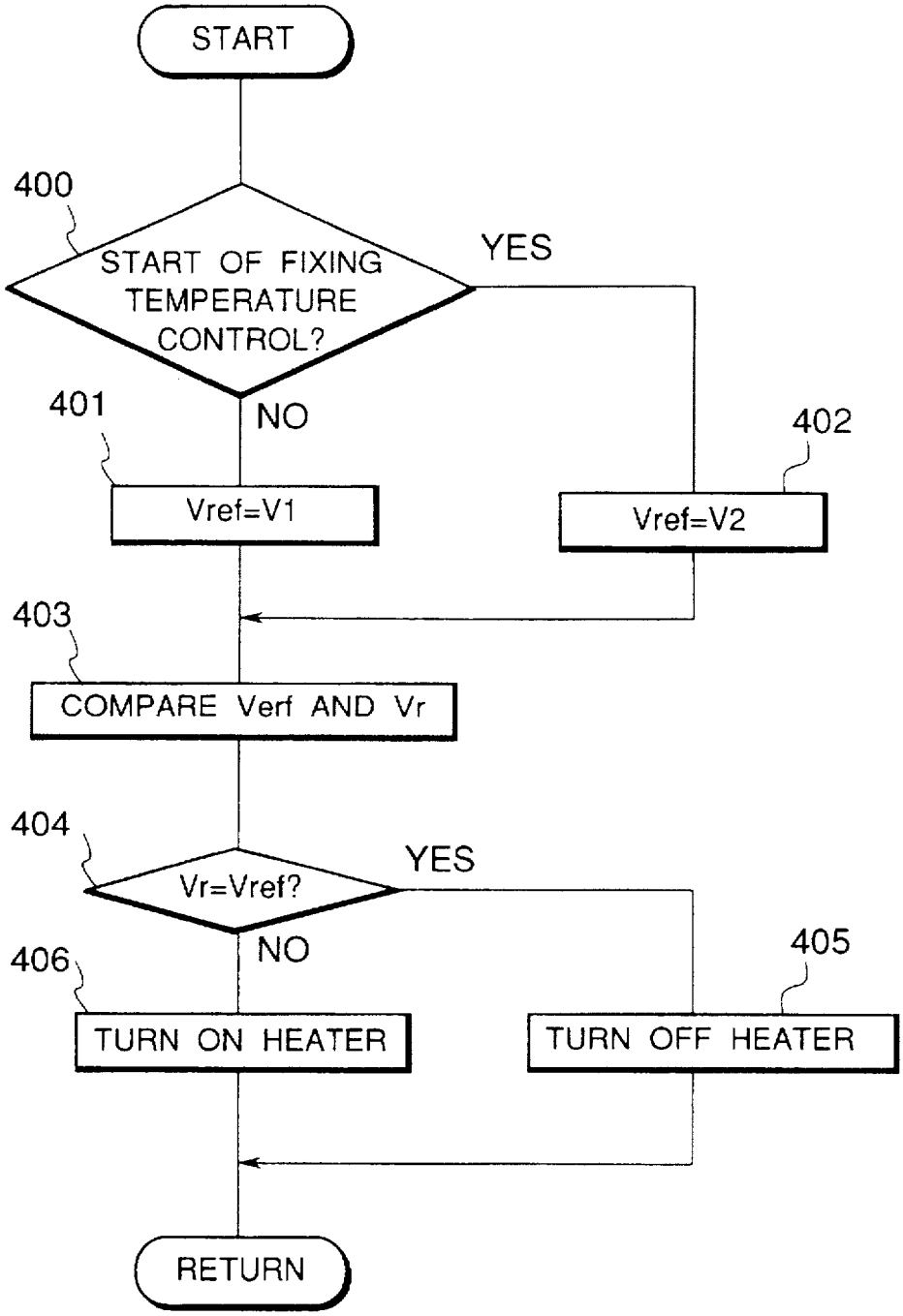
FIG. 1 is an example of a flowchart which shows the temperature control operation.
Figure 2:
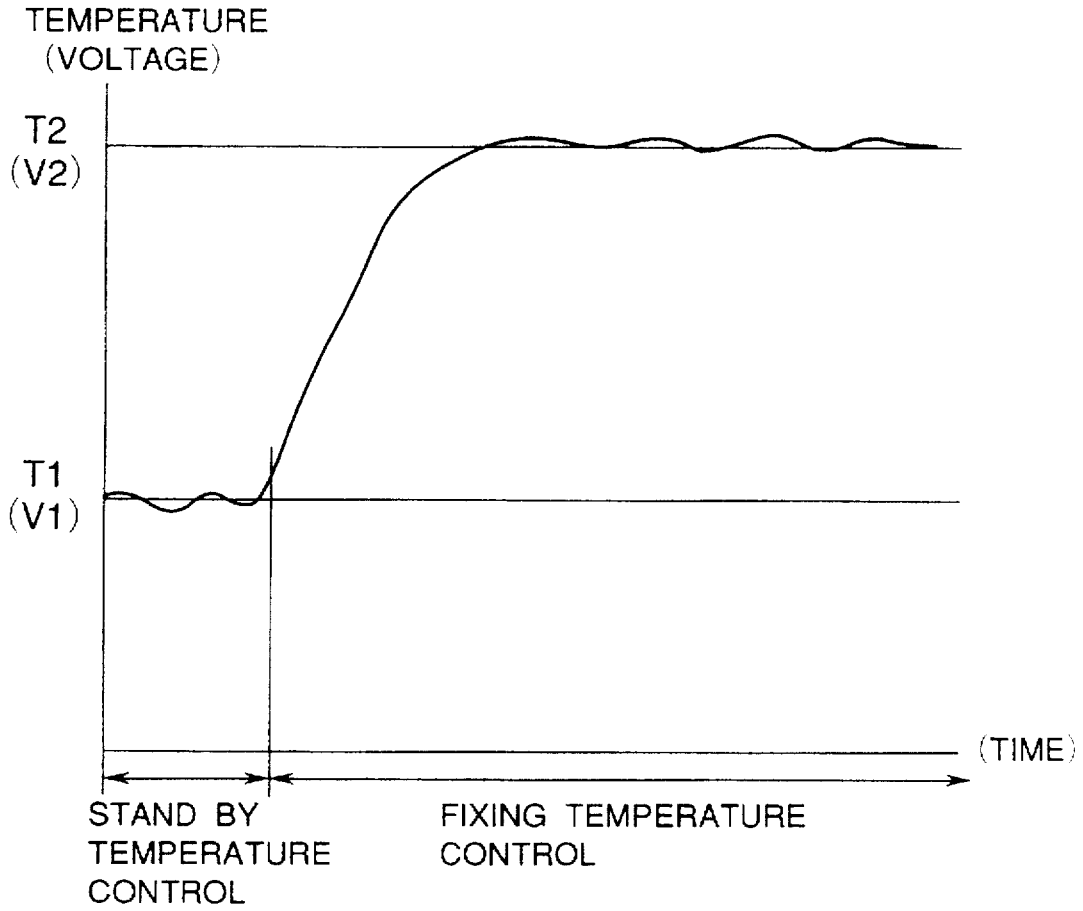
FIG. 2 is an explanatory drawing which shows a temperature change of the conventional heating roller described above.
Figure 3:
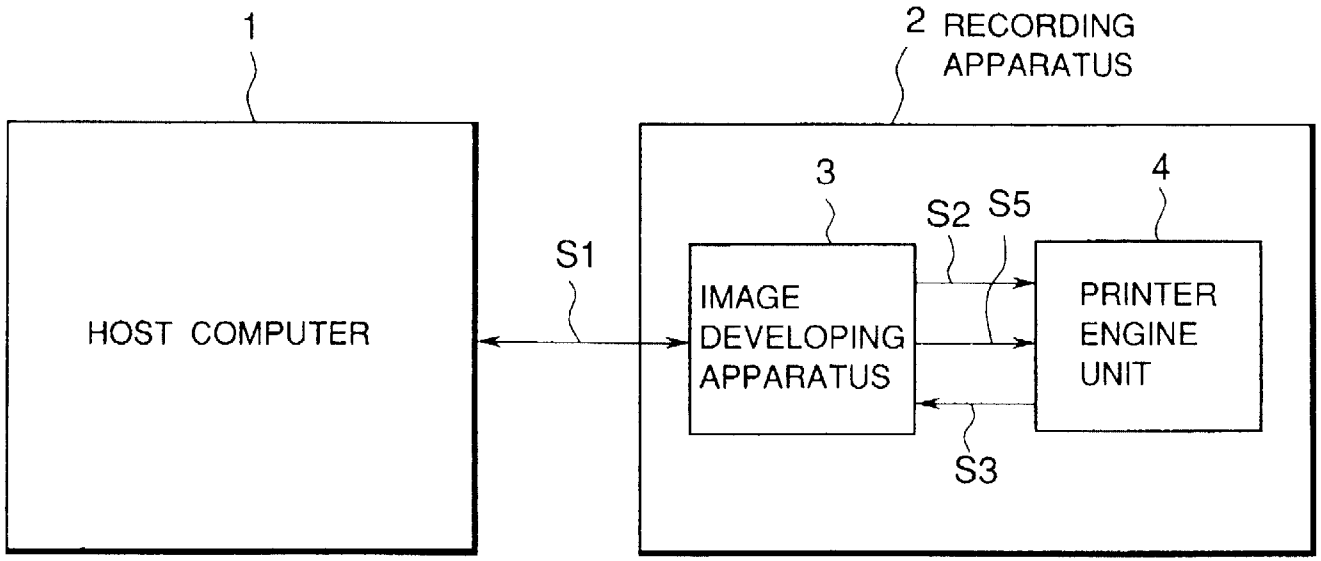
FIG. 3 is a block diagram which shows a state of connection between the recording apparatus, which has the conventional heat fixing roller type fixing device described above, and the host computer.
Figure 4:
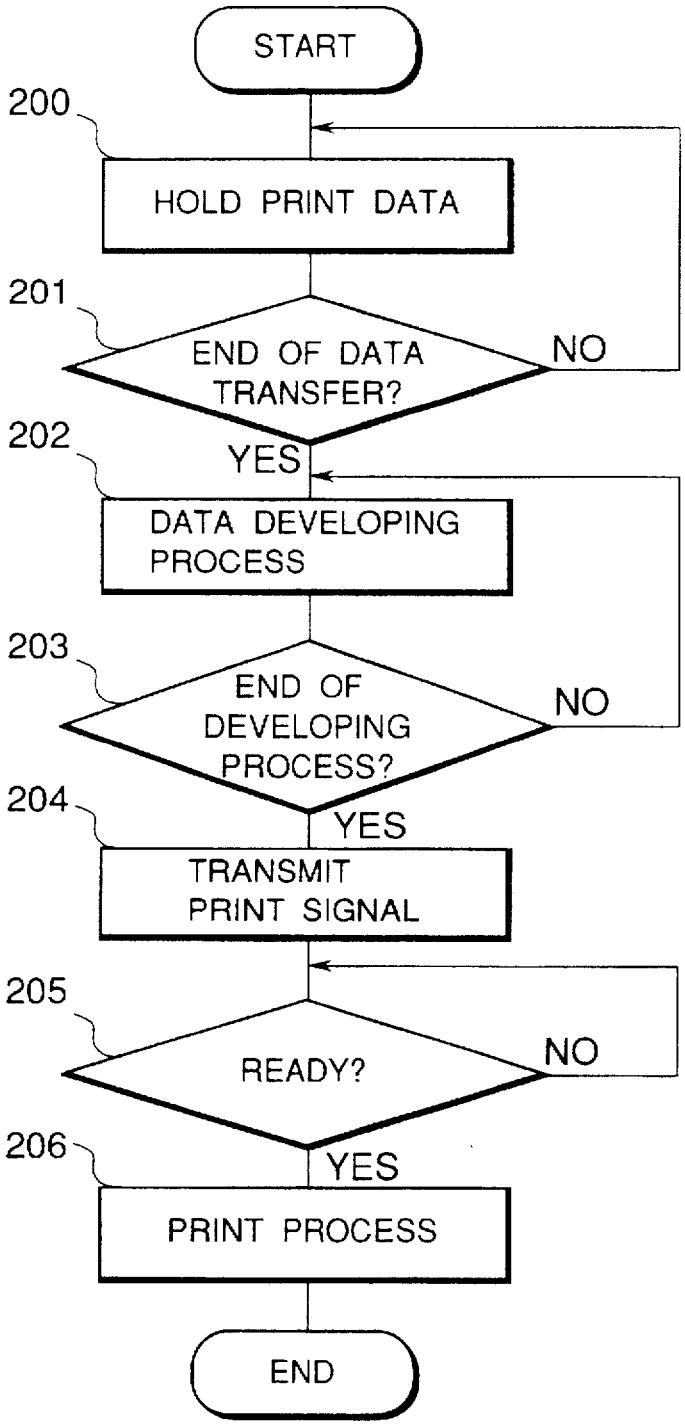
FIG. 4 is a flowchart which shows an operation performed from the moment the image developing apparatus receives print data transmitted from the host computer in the conventional recording apparatus.
Figure 8:
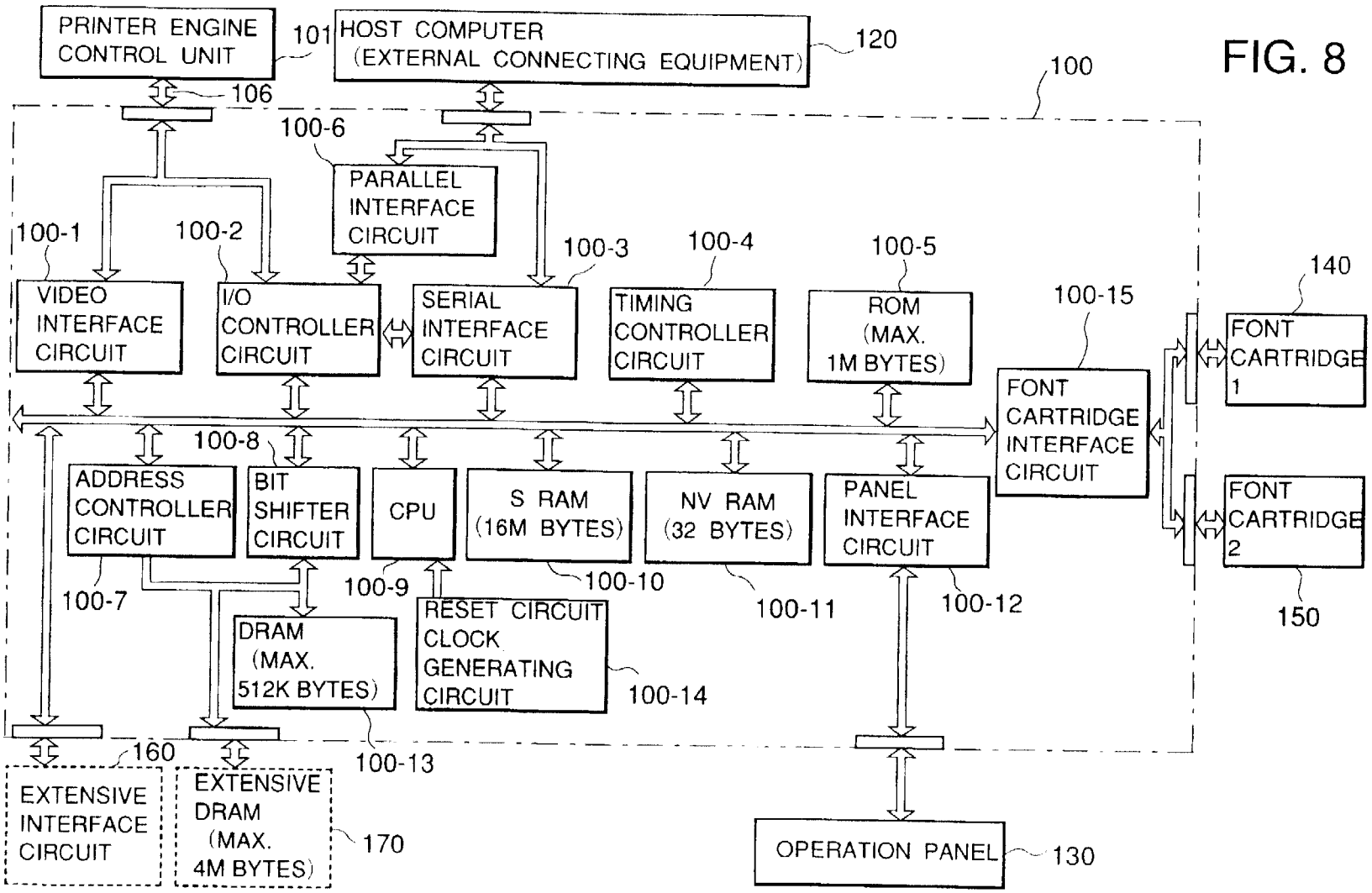
FIG. 8 is a block diagram which shows an internal control circuit of a printer controller of the apparatus associated with the embodiment.

FIG. 8 is the block diagram which shows the internal control circuit of the printer controller 100 of the apparatus associated with the embodiment. As shown in the drawing, in the apparatus, components including a video interface circuit 100-1 and a timing controller circuit 100-4 are connected to a system bus 200, and an operation panel 130 is controlled by the printer controller 100. The operation panel 130 is usually comprised of a liquid crystal display, an LED, and a tact switch. A user sets the fixing temperature in accordance with the operation flowchart shown in FIG. 3 through the operation panel 130.

The same control as the one described above is also possible through a host computer (externally connected equipment) 120. More specifically, on the host computer 120, the operation flowchart is displayed in a menu of a CRT, and the user can set the fixing temperature in the same manner as that described above through input equipment such as a keyboard and mouse connected to the host computer.

Figure 9:
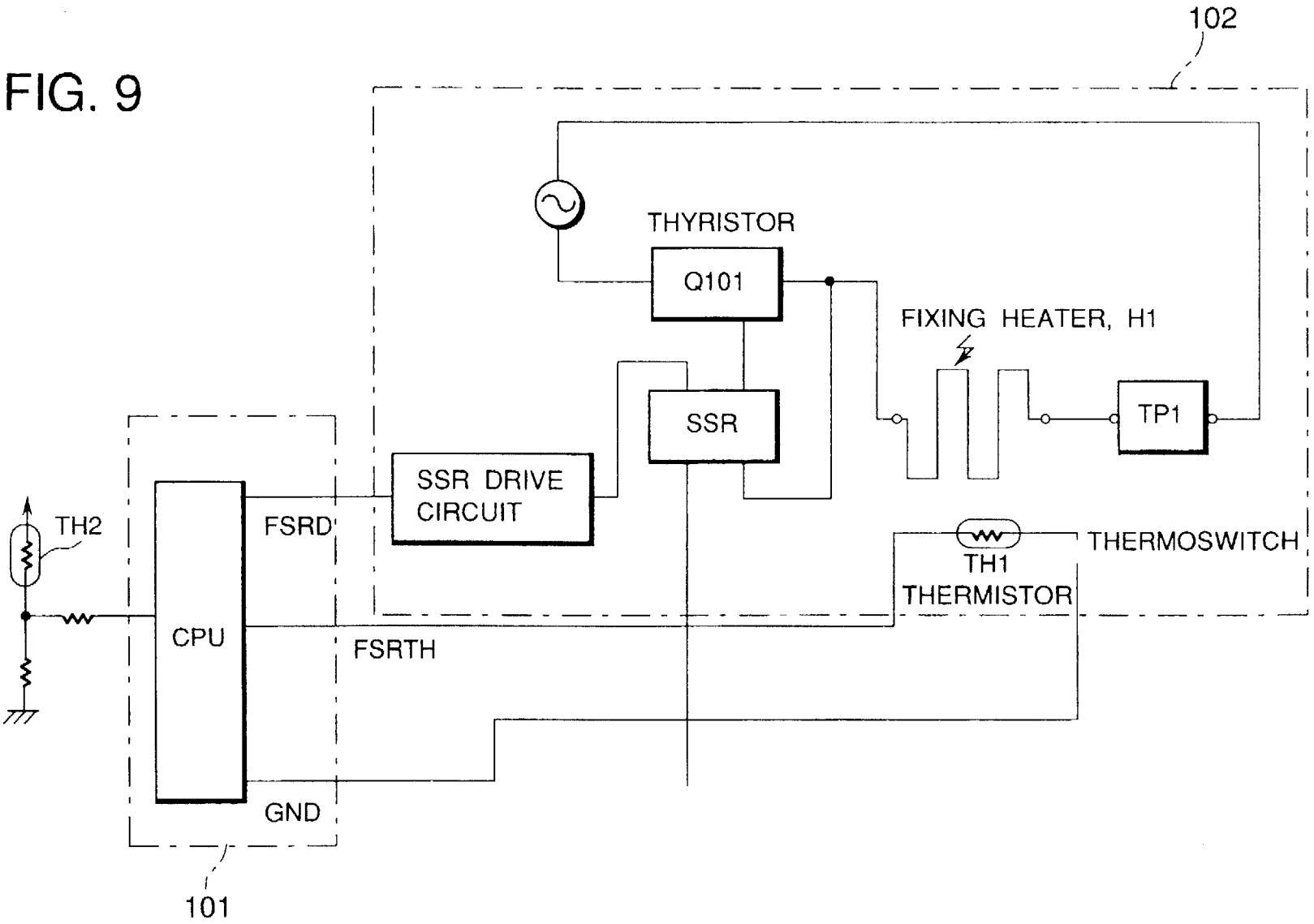
FIG. 9 is a block diagram which shows a configuration of a fixing device control unit 102.

FIG. 9 is the block diagram which shows the configuration of the fixing device control unit 102. The electric power supplied to a fixing heater H1, for which a halogen heater or the like is used, is controlled by a thyristor Q101. TP1 is a thermo-switch for cutting off the supply of the electric power in the case of an abnormal temperature rise.

The printer engine control unit 101 turns ON/OFF a heater driving signal FSRD in accordance with an output FSRTH received from a thermistor TH1, which detects a temperature (the temperature of the fixing roller) in the vicinity of the fixing heater H1, thereby controlling the temperature of the fixing roller to the target fixing temperature.

The thyristor Q101 is controlled by a solid-state relay SSR and an SSR driving circuit SSRD so that it is turned ON/OFF at a zero cross point.

A thermistor TH2 is provided to detect a temperature in the apparatus.

FIG. 10 is the flowchart which shows the procedure for controlling the fixing temperature in the apparatus associated with the embodiment. FIG. 11 shows the table of commands in the video interface.

The user of the printer selects either the normal mode or the manual mode for setting the fixing temperature through the operation panel 130. When the normal mode is selected, the system proceeds from a step S1 to a step S3 of the flowchart in FIG. 10 to execute general fixing temperature control which has conventionally been conducted.

On the other hand, when the manual mode is selected, the system proceeds from the step S1 or a step S2 to a step S4 to determine how to control the fixing temperature during a standby period. More specifically, in a step S5, setting is made for a case wherein the supply of the electric power to the fixing heater is cut off during the standby period for energy saving is made. In this case, for example, the printer controller 100 performs the control for cutting off the supply of the electric power to the fixing heater in accordance with a predetermined standby time. To be specific, based on the table of the commands for the video interface shown in FIG. 11, EC2 is used to specify rest, thus cutting off the electric power to the fixing heater. Alternatively, a time from the completion of printing to the cutoff of the electric power to the fixing heater may be set through the operation panel 130. In this case, when the set time elapses, the printer controller 100 issues EC2.

When the electric power is supplied to the fixing heater during the standby period; taking the set temperature of the fixing heater as "t", the set temperature comes in the following four groups, $t \geqq 28°$ C., $23°$ C. $\leqq t < 28°$ C., $18°$ C. $\leqq t < 23°$ C., $t < 18°$ C. (steps S6 to S9). And the set temperature for the fixing heater during the standby period is determined by keying a preset standby temperature to each environmental temperature (steps S10 to S13). The use environmental temperature may be entered by the user through the operational panel 130; the temperature obtained from the aforesaid thermistor TH2 may alternatively be sent out as a status, which will be discussed later, from the engine control unit 101. Thus, about 4 seconds are required for the temperature to increase from the standby temperature to the fixing temperature regardless of the use environment.

Lastly, when the user has selected, through the operation panel 130, the manual mode for setting the fixing temperature for printing, the fixing temperature, which is higher than that in the normal mode, is set to suit recording on thick paper. To be specific, in the manual mode, the printing temperature is set to 195° C. in a step S15, while in the normal mode, the temperature is set to 185° C. in a step S16.

When the use environmental temperature is $t \geqq 28°$ C., the fixing temperature is set to 185° C. which is the normal mode. This is because there is a danger that the heat will cause the temperature of the components of the fixing device to rise, preventing an expected service life thereof from being maintained.

The value set by the user is sent to the engine control unit 102 by a command EEC62 shown in FIG. 11 and the actual temperature control is performed based on the set value.

Figure 12:
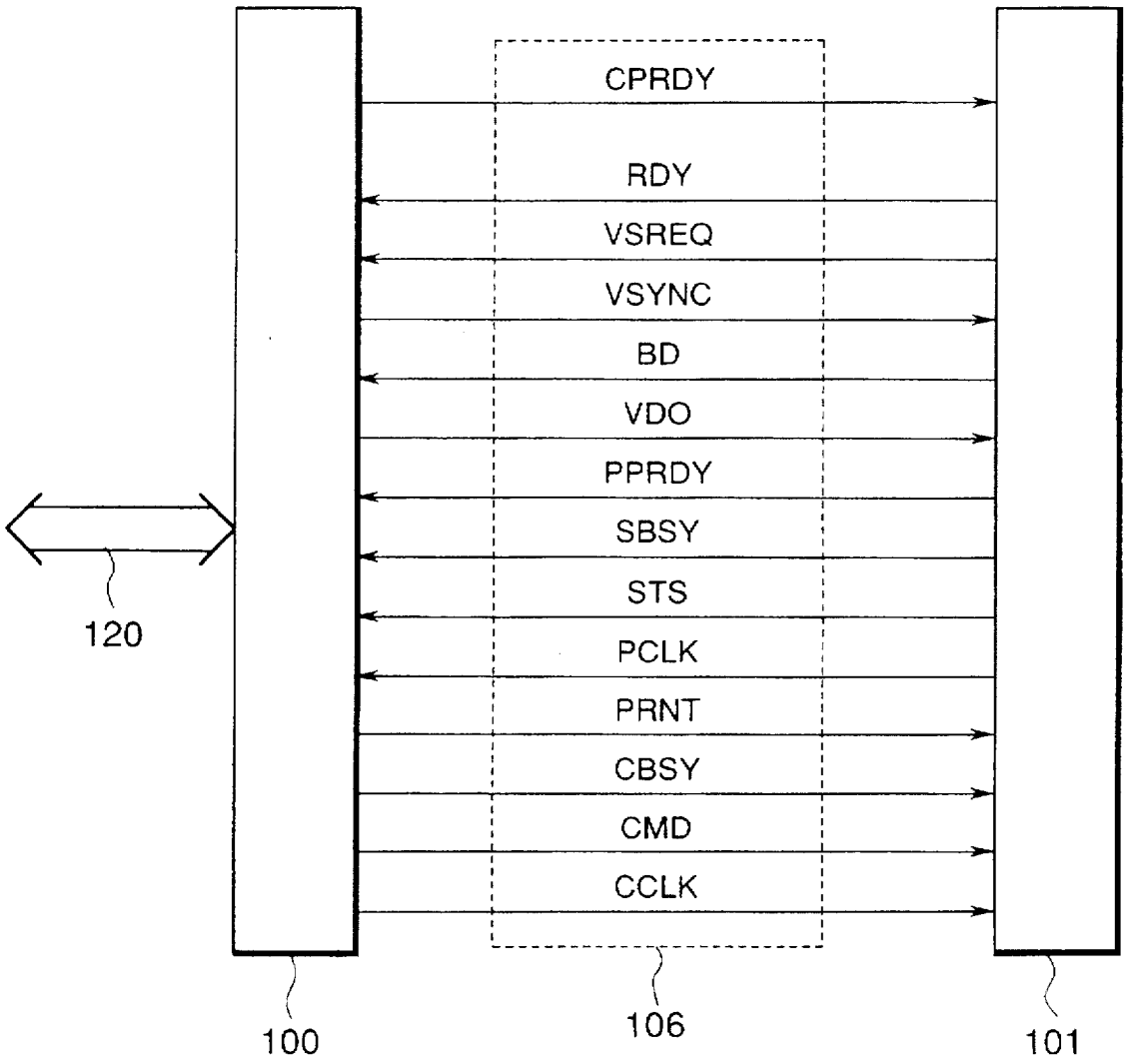
FIG. 12 is a diagram which shows a control circuit of a video interface unit.
Figures 13A, 13B, 13C, 13D, 13E, 13F:
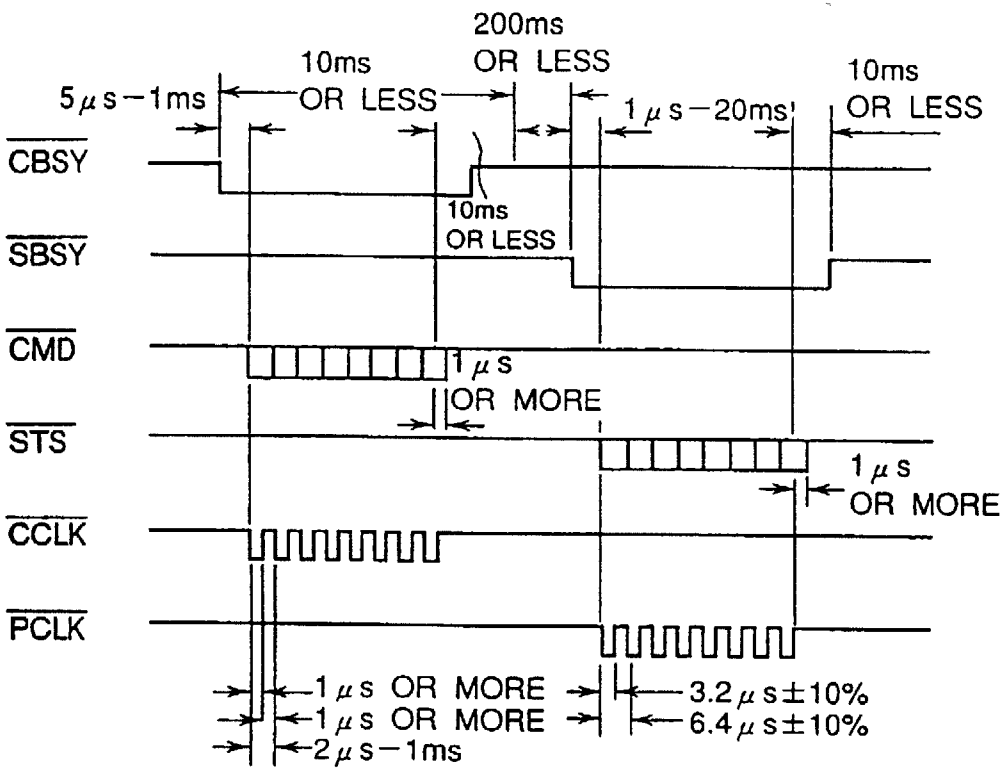
FIGS. 13(*a*)–(*f*) represent an operation timing chart of a video interface 106.

FIG. 12 shows the video interface unit, namely, the printer controller 100, the printer engine controller 101, and the video interface 106 which is placed between the former two. FIGS. 13(*a*)–(*f*) represent the operation timing chart of the video interface 106; since the specific operation thereof is publicly known, the explanation thereof will be omitted.

FIG. 14 shows the details of the command EEC62 in the video interface shown in FIG. 11. The command EEC62 is used for communication as a command CMD.

In FIG. 14, if the 2nd bit is true, then the fixing temperature is set to the normal mode. If the 3rd bit is true, then the fixing temperature is set to the manual mode. As shown in FIG. 15, the four types of temperature for standby described above are set using two bits, namely, the 4th and 5th bits. If the 7th bit is true, then the manual mode, which sets the printing temperature to 195° C., is engaged.

As explained above, according to the present embodiment, a fixing temperature suited for thick recording paper can be set by setting an optimum fixing temperature through external equipment such as the operation panel and the host computer and selecting the manual mode. In addition, a warm-up time of the fixing heater can be set to a constant value under any environments by setting an optimum standby temperature for each environmental temperature.

[EMBODIMENT 2]

The following describes Embodiment 2:

In Embodiment 2, a method for implementing finer setting of the temperature at the time of printing for the use environmental temperature will be explained. The configuration and the basic operation of the image forming apparatus of Embodiment 2 is the same as those of Embodiment 1 previously described; therefore, the illustration and explanation thereof will be omitted.

Figure 16:
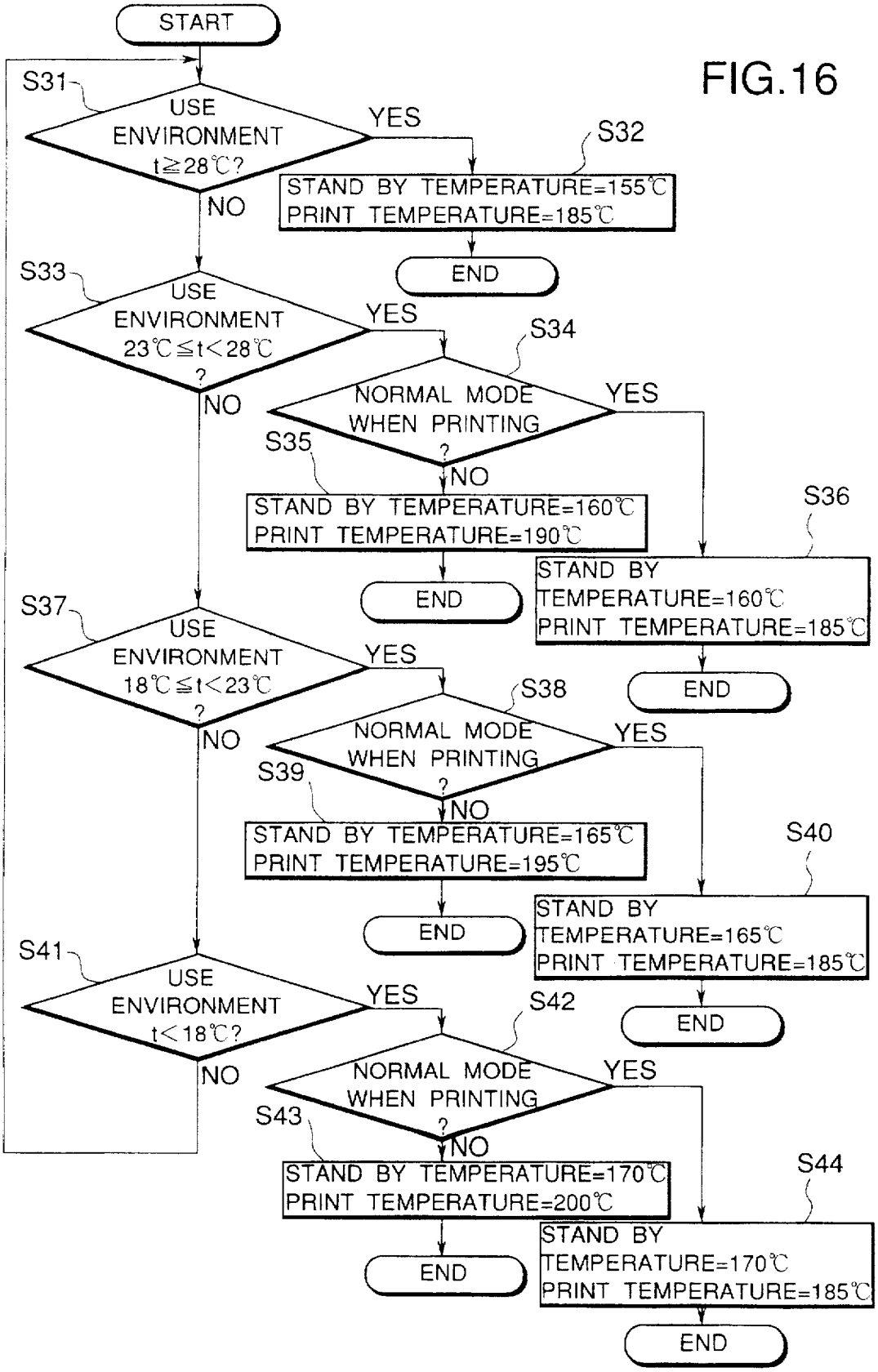
FIG. 16 is a flowchart which shows an operation of an apparatus associated with Embodiment 2.

FIG. 16 shows the flowchart which indicates the operation of an apparatus of Embodiment 2. FIG. 17 and FIG. 18 show the command data for the video interface in Embodiment 2.

As shown in FIG. 16, if the use environmental temperature "t" of the apparatus is t≧28° C. (when a determination result in a step S31 is YES), then the temperature is set to 185° C., which is the normal mode, in a step S32 for the same reason as that in Embodiment 1, that is, in order to avoid the influences exerted by heat on the components of the fixing device.

Under the three environmental conditions of steps S33, S37, and S41, if the normal mode is set in steps S34, S38, and S42, then the following printing temperatures are selected; 190° C. in a step S35, namely, 23° C.≦t<28° C., 195° C. in a step S40, namely, 18° C.≦t<23° C., and 200° C. in a step S44, namely, t<18° C.

Thus, decreasing the environmental temperature allows the printing temperature to be raised.

As shown in FIG. 18, the four different temperatures are set by the two bits, the 4th and 5th bits, for standby and printing, respectively. As shown in FIG. 17, if the 7th bit is true, then the standby temperature is set for the manual mode and the printing temperature is fixed to the same temperature as that of the normal mode.

The operation method employed by the user for the apparatus of the present embodiment is the same as that in Embodiment 1 described above; therefore, the explanation thereof will be omitted.

[EMBODIMENT 3]

In Embodiment 3, a fixing temperature control method for a case, wherein thinner recording paper than a standard paper is used, will be explained. The configuration and the basic operation of the image forming apparatus of Embodiment 3 are the same as those of Embodiments 1 and 2 previously described; therefore, the illustration and explanation thereof will be omitted.

FIG. 19 shows the flowchart which indicates the temperature setting operation of the apparatus of Embodiment 3. When the normal mode is set in Embodiment 3, printing temperatures shown below will be selected.

Specifically, if the use environmental temperature "t" of the apparatus is determined to be t≧28° C. in a step S51 in FIG. 19, then the printing temperature is set to 170° C. in a step S53. If the use environmental temperature is 23° C.≦t<28° C., then the temperature is set to 175° C. (step S57), and if it is 18° C.≦t<23° C., then the temperature is set to 180° C. (step S61). If the use environmental temperature is t<18° C., then the printing temperature is set to 185° C. (step S65).

Thus, when the thin recording paper is used, the fixing temperature for printing is decreased according to the environmental temperature of the apparatus to optimize the current drain of the apparatus, thus making it possible to achieve the image forming apparatus which enables energy saving without causing an increase in cost.

In this embodiment also, the method employed by the user to operate the apparatus is the same as that in the embodiments described above; therefore, the explanation thereof will be omitted.

In Embodiments 1 through 3 discussed above, the description was given to cases wherein the set temperatures for standby and printing are significantly restricted for the purpose of making the explanation easier, however, it is needless to say that the present invention is not limited to them; finer adjustment may be adopted for control as an alternative.

In addition, to respond to a user's request for enhancing or weakening the fixing strength in the normal mode, which has been set, it is possible to design the mode so that it permits further adjustment. More specifically, a central value is preset for the normal mode and the fixing property can be selected for a higher or lower level with respect to the central value by a compensating mode which is prepared in advance. This enables finer adjustment.

The all control systems described above can make use of existing video interface control systems, requiring only the addition of software, eliminating the need of any new hardware. This makes it possible to provide a recording apparatus featuring high printing quality and energy saving without causing an increase in cost.

The present invention is applicable to a system comprising a plurality of equipment or a system comprising single equipment. Furthermore, the present invention may, of course, be applied to a case wherein a program is supplied to a system or equipment.

As discussed above, according to the embodiment, high-quality images with stable fixing property can be obtained even under the low-temperature environment for the thick recording paper by adjusting the fixing temperatures to an optimum value in accordance with the use environment of the apparatus, and the current drain of the apparatus can be optimized by setting the fixing temperature to a low level for the thin paper.

As a modification of Embodiments 1 through 3 described above, the printing mode may be designed so as to enable the user to select a quick mode, normal mode or energy-saving (slow) mode through the operation panel 130. In this case, the printer controller 100 sets the 4th and 5th bits of the command EEC62 so that the standby temperature (or printing temperature) rises to the printing temperature in about 2 seconds independently of the environmental temperature in the quick mode, for example, in accordance with the environmental temperature detected by the thermistor TH2 and the mode set by the user. Likewise, the 4th and 5th bits of the command EEC62 are set so that the temperature rises to the printing temperature in about 4 seconds in the normal mode or in about 6 seconds in the slow mode independently of the environmental temperature.

[EMBODIMENT 4]

Figure 20:
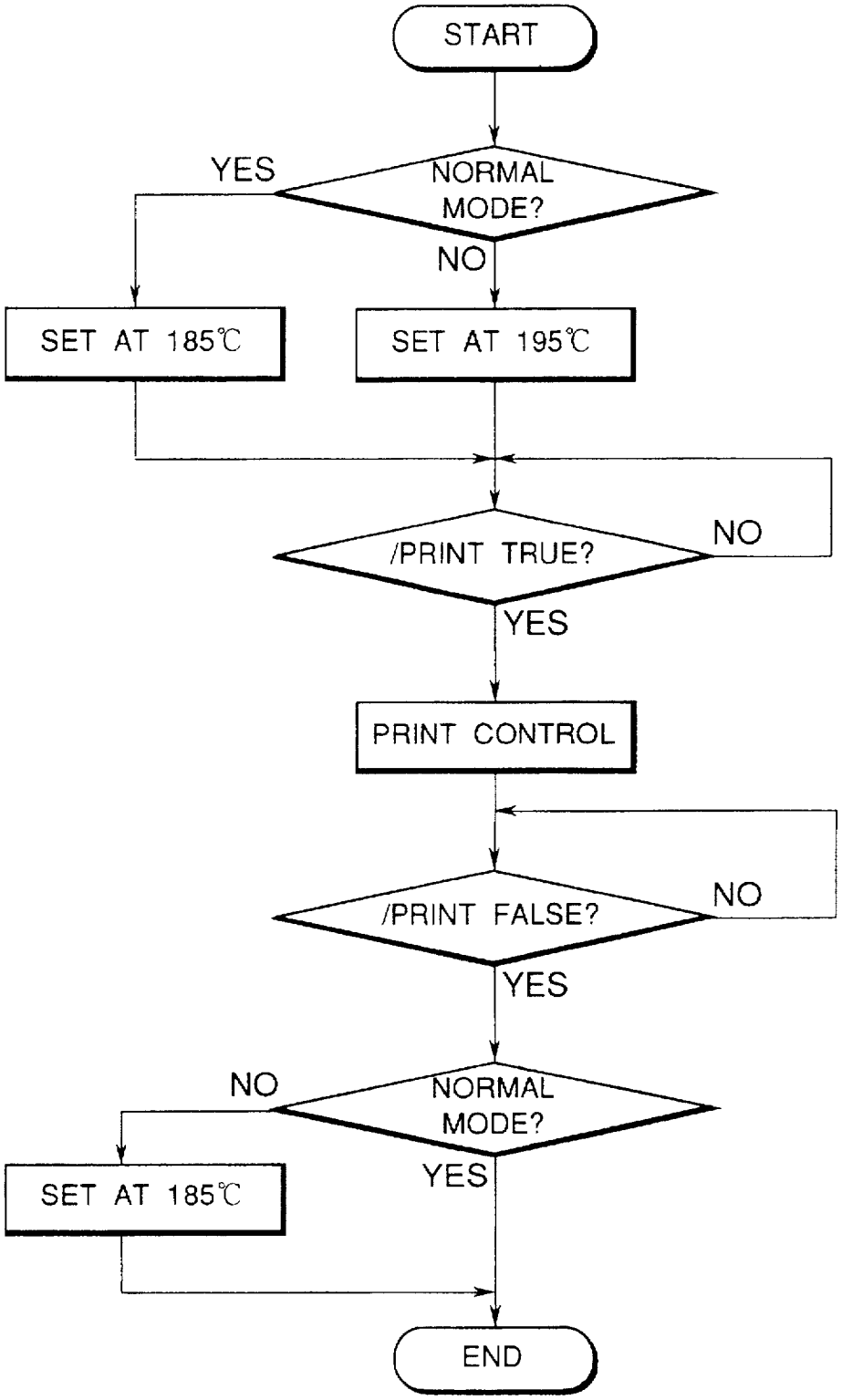
FIG. 20 is a flowchart which shows temperature control in Embodiment 4 of the present invention.

Embodiment 4 will be explained with reference to FIGS. 20 through 22. The apparatus of this embodiment is an example wherein the present invention is applied to a laser beam printer. The basic configuration thereof is the same as that explained in Embodiments 1 through 3; therefore the explanation of overlapped sections will be omitted.

In this embodiment, the temperature control is conducted by transmitting a temperature, which is set according to a fixing temperature control mode set through the operation panel 130 or the host computer 120, to the engine control unit 101 as the aforesaid command. The following describes the temperature control of this embodiment with reference to the flowchart of FIG. 20.

First, the user decides whether to select the normal mode or not for setting the fixing temperature through the operation panel 130 or the host computer 120. The user's decision made on the mode setting is transmitted in the form of the command EEC64 (to be discussed later) to the engine control unit 101. If the normal mode is selected, then the mode, which controls the fixing temperature to the general fixing temperature 185° C. for printing as in the conventional case, is executed. This mode is suited when a recording material of a standard thickness is used.

If non-normal mode (hereinafter referred to as "manual mode") is selected, then the fixing temperature is controlled to 195° C. for printing. This mode is suited for a case where a thick recording material such as proper bond paper is used.

Thus, as soon as the mode is set and the fixing temperature (printing temperature) is determined, the printer controller 100 sends out the command EEC64 shown in the table of commands for the video interface of FIG. 21 to the engine control unit 101. The command EEC64 consists of two bytes of code, the lower byte specifying the temperature. FIG. 22 shows a detailed configuration of the lower byte. If the 2nd bit is true, then the normal mode is engaged; if the 3rd bit is true, then the manual mode is engaged.

When the host computer 120 issues the print start request signal, the printer controller 100 sets a print signal /PRNT on the video interface to true and controls the engine control unit 101 to perform the printing control while issuing a predetermined command and receiving a status signal.

At this time, if the selected mode is the normal mode, then the fixing device is maintained at the 185° C. fixing temperature and it performs the fixing operation without causing adverse influences by heat even with thin recording materials. If the selected mode is the manual mode, then the fixing device is maintained at the 195° C. fixing temperature and it performs good fixing operation without causing a fixing failure even with thick recording materials.

If, however, during the fixing operation in the manual mode, the print signal /PRNT on the video interface turns to FALSE, causing the apparatus to wait for the next printing cycle to start with the fixing temperature still set at 195° C. after the completion of the fixing operation, then the service life of a rubber component such as a pressure roller, a bearing component, and other similar component will be shortened and an energy consumption problem will result.

To avoid such a problem, in the present invention, the fixing temperature is switched to 185° C. when the fixing operation is completed if the fixing operation has been carried out in the manual mode.

There are the following three possible ways to perform the control to lower the fixing temperature:

1. Whenever the print signal received from the printer controller 100 turns to FALSE, the engine control unit 101 forcibly sets the temperature to 185° C.
2. The printer controller 100 sets the print signal to FALSE and also specifies the fixing temperature as 185° C. by the command EEC64. The engine control unit 101 sets the fixing temperature at 185° C. according to the specification.
3. After the completion of the fixing operation, the host computer 120 switches the mode to the normal mode, thereby to send the command EEC64, which specifies the fixing temperature as 185° C., from the printer controller 100 to the engine control unit 101. The engine control unit 101 then sets the fixing temperature to 185° C. in accordance with the specification.

In every method described above, the control signal of the video interface is used to transmit FALSE of the print signal or the command EEC64 to the engine control unit 101, thus switching the fixing temperature.

As described above, according to the present embodiment, by selecting the manual mode, the fixing temperature suited for thick recording materials can be specified to produce high-quality images and the fixing temperature can be set back to the normal fixing temperature after printing, thus preventing adverse influences exerted by heat.

[EMBODIMENT 5]

Figure 23:
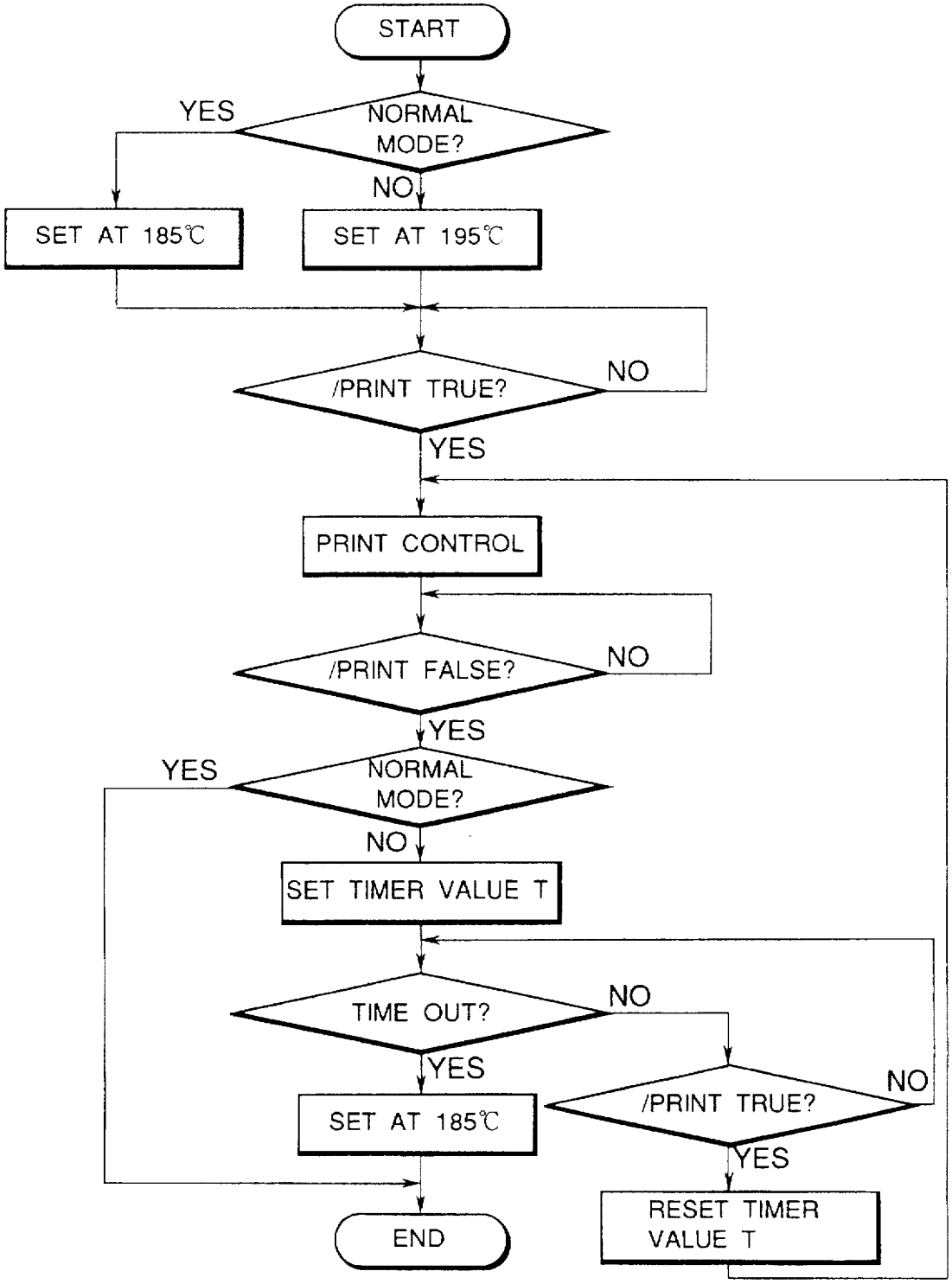
FIG. 23 is a flowchart of temperature control in Embodiment 5 of the present invention.

Embodiment 5 of the present invention will now be explained with reference to FIG. 23. Any sections that are common to Embodiment 4 will be given the same reference numerals, with explanation thereof omitted.

In this embodiment, a condition for automatic switching to the normal mode from the manual mode, which is originally set, is established by monitoring time by a software-based timer.

The basic operation is the same as that of Embodiment 4; therefore, only different points will be discussed. FIG. 23 is the flowchart which shows the operation of this embodiment.

When the print signal /PRNT turns to FALSE, a timer value T is set. Then, counting is started and the printing temperature is not changed to 185° C. until a timer counts up.

On the other hand, if the print signal /PRNT turns to TRUE again before the timer counts up, then the timer value T is reset and the program proceeds to a print control sequence.

As a result, the mode is not switched to the normal mode unless a given time elapses even after a print job is completed. This ensures improved operability.

As in Embodiment 4, the fixing temperature control can be conducted in the following three methods:

1. The timer value T is counted by the printer controller 100. The timer's having counted up is transmitted in terms of a command and the temperature is forcibly set to 185° C. by the engine control unit 101.
2. The timer value T is counted by the printer controller 100, and when the controller counts it up, the fixing temperature is specified as 185° C. by the command EEC64. The engine control unit 101 sets the fixing temperature to 185° C. in accordance with the specification.
3. The timer value T is counted by the host computer 102, and when the computer counts it up, the mode is forcibly switched to the normal mode, thereby to cause the printer controller 100 to send the command EEC64, which specifies the fixing temperature as 185° C., to the engine control unit 101. The engine control unit 101 sets the fixing temperature to 185° C. in accordance with the specification.

In every method described above, the control signal of the video interface is used to perform the control. The user's operation method is the same as that for Embodiment 4, and therefore, it is omitted.

[EMBODIMENT 6]

Figure 24:
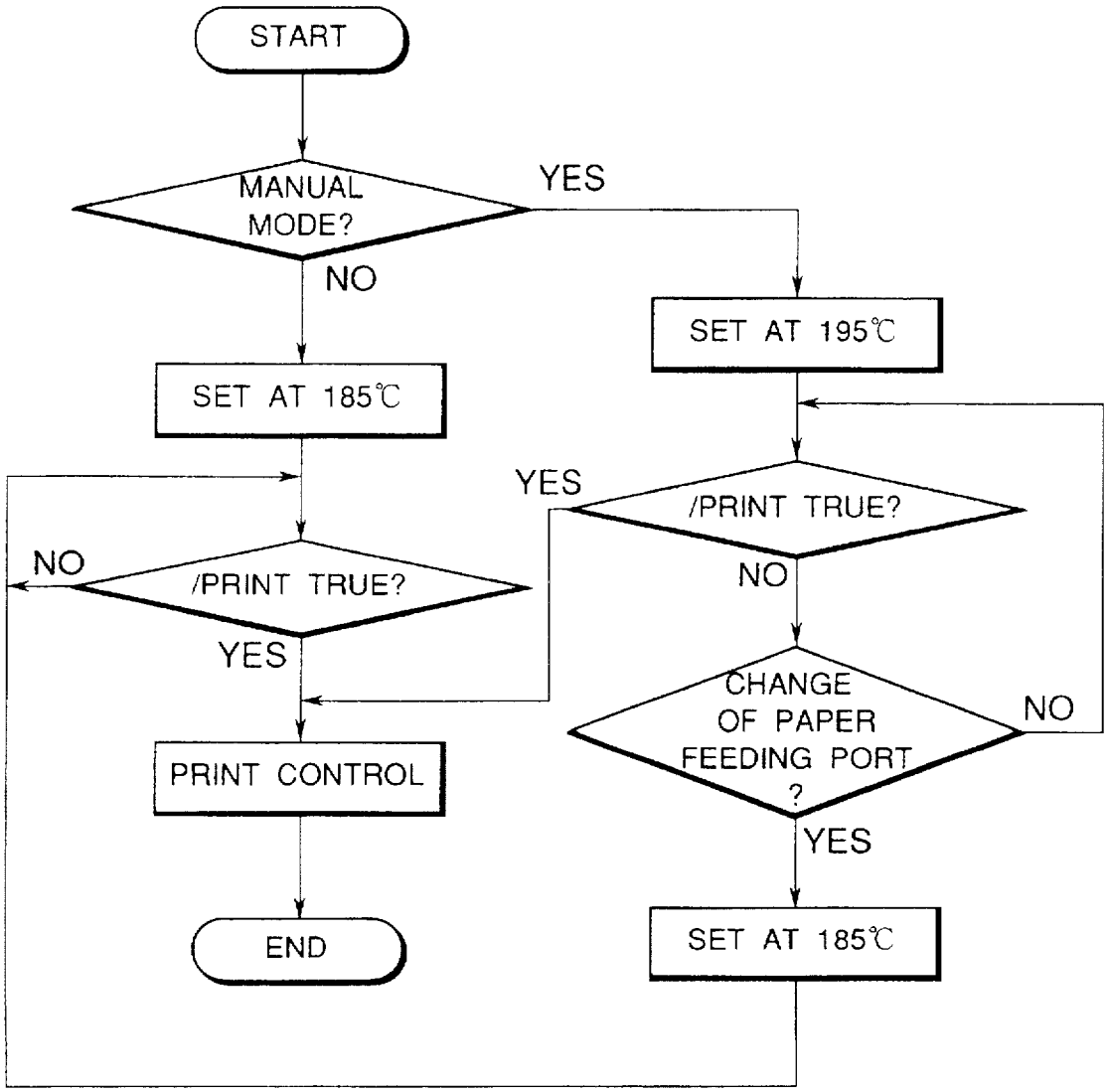
FIG. 24 is a flowchart of temperature control in Embodiment 6 of the present invention.
Figure 25:
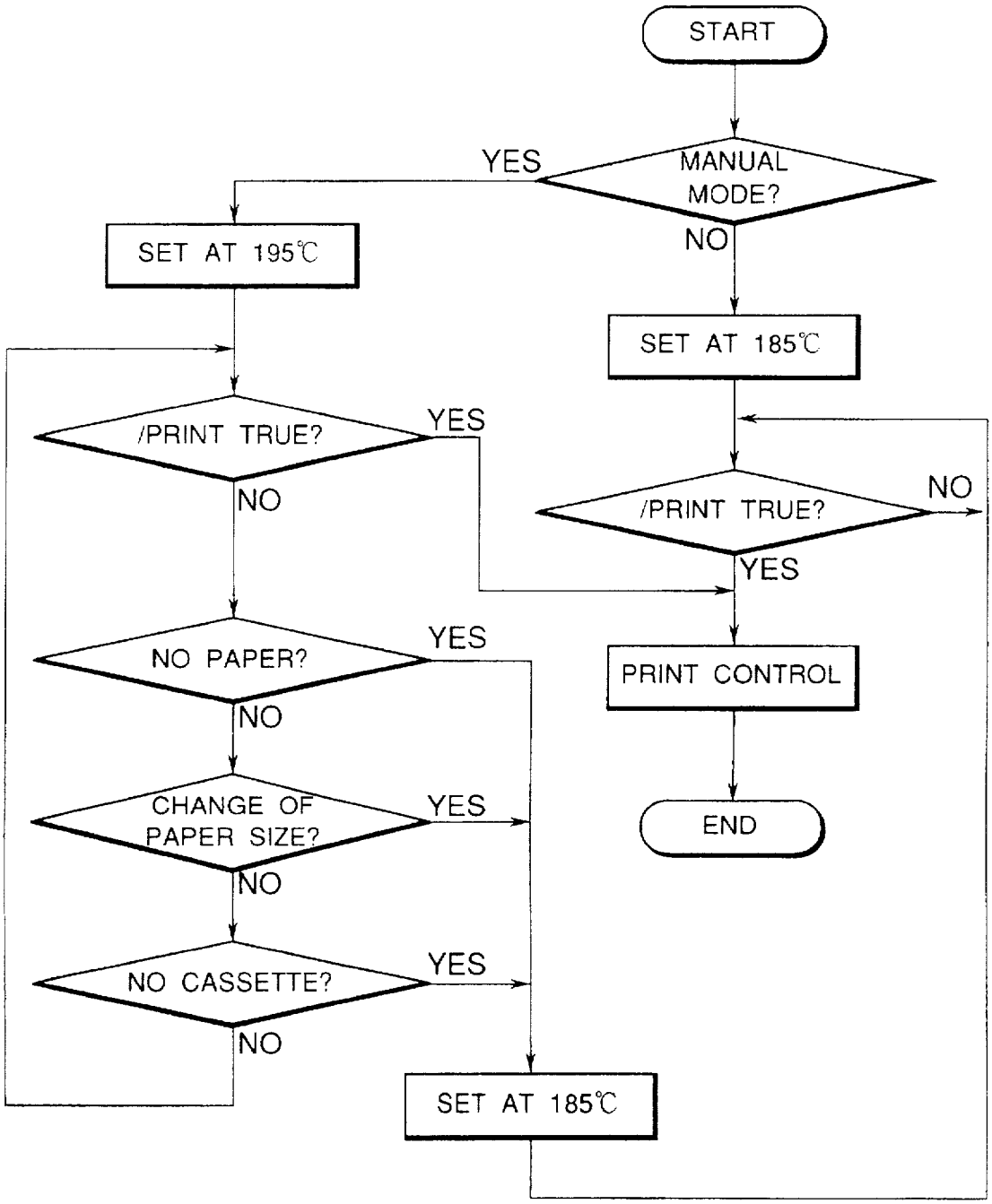
FIG. 25 is a flowchart of another temperature control in Embodiment 6 of the present invention.

Embodiment 6 of the present invention will now be explained with reference to FIG. 24 and FIG. 25. Any sections that are common to those in Embodiments 4 and 5 will be given the same reference numerals, with the explanation thereof being omitted.

In this embodiment, it is assumed that an operation is performed when the manual mode is shifted to the normal mode (set back to the normal state), and control is carried out so that such a shift is automatically made whenever such an operation is performed.

The basic operation is the same as that of Embodiments 4 and 5; therefore, only different points will be discussed. This fixing temperature control is aimed to improve the fixing property for thick paper; the paper is actually set, for printing, in a cassette, manual feeder or the like, which is different from those for general recording paper.

Hence, the control for shifting the manual mode back to the normal state is carried out in a manner that the manual mode is switched back to the normal mode automatically only when a paper feeding port has been changed.

Further, if the cassette is taken out to replace the aforesaid thick paper, then a status, wherein no cassette is present, takes place. Likewise, a status change takes place when paper runs out or a recording paper size changes. The control is therefore carried out so that the mode is automatically switched to the normal mode whenever such a change takes place. FIG. 24 and FIG. 25 are the flowcharts which show the operation of this embodiment.

After the completion of the fixing operation, the fixing temperature is set to 185° C. as in Embodiment 4 or 5 even if the mode is the manual mode.

As in Embodiment 1, there are the following three possible ways to carry out the fixing temperature control:

1. The status such as the absence of the cassette is monitored by the printer controller 100, and the occurrence of such a status is transmitted in terms of a command, then the engine control unit 101 forcibly sets the fixing temperature to 185° C.
2. The status such as the absence of the cassette is monitored by the printer controller 100, and the fixing temperature is specified as 185° C. by the command EEC64. The engine control unit 101 sets the fixing temperature to 185° C. in accordance with the specification.
3. The status such as the absence of the cassette is monitored by the host computer 102. When such a status occurs, the mode is forcibly shifted to the normal mode, thereby causing the printer controller 100 to send the command EEC64, which specifies the fixing temperature as 185° C., to the engine control unit 101. The engine control unit 101 sets the fixing temperature to 185° C. in accordance with the specification.

In every method described above, the control signal of the video interface is used to perform the control. The user's operation method is the same as that for the embodiments discussed above and therefore it is omitted.

All the control systems described above eliminate the need for any new hardware by utilizing the existing video interface control systems and they require only the addition of software. This makes it possible to provide an image forming apparatus which is capable of achieving energy saving while maintaining high-quality print quality without causing an increase in cost.

[EMBODIMENT 7]

Embodiment 7 of the present invention will now be explained with reference to FIGS. 26, 27A and 27B. This embodiment is an example wherein the present invention is applied to a laser beam printer. The basic configuration thereof is the same as that explained in Embodiments 1 through 6; therefore the explanation will be given only on novel sections invented. Additionally, the sections common to those in Embodiment 1 are given the same reference numerals, with the explanation thereof omitted.

Figure 26:
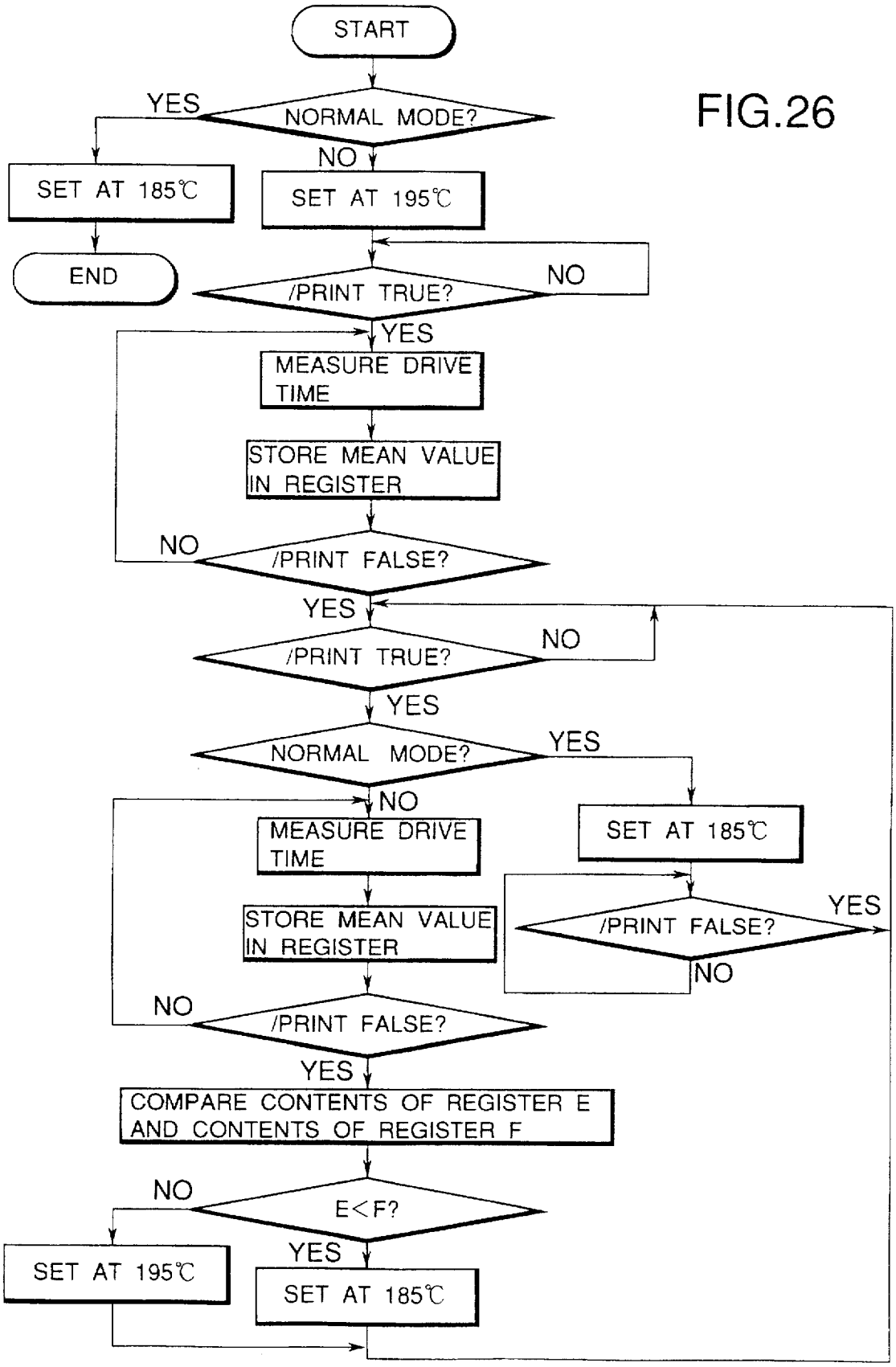
FIG. 26 is a flowchart of temperature control in Embodiment 7 of the present invention.

FIG. 26 is the flowchart in Embodiment 7 of the present invention. This flowchart centers around the fixing temperature control and therefore description of printing control including a so-called print sequence is omitted.

First, the fixing temperature control of this embodiment will be explained, referring to the flowchart of FIG. 26. This embodiment is also designed to enable the user to select either the normal mode, wherein the fixing temperature is controlled to 185° C., or the manual mode, wherein the fixing temperature is controlled to 195° C., for setting the fixing temperature. When the manual mode is selected, the temperature to be set is determined to control the fixing temperature to 195° C. Then, the engine control unit 101 starts a predetermined printing operation when the print start signal /PRNT received from the controller 100 turns to TRUE. And when the temperature control of the fixing device is begun, the engine control unit 101 measures the time of the control signal FSRD which drives the fixing heater shown in FIG. 9.

Figure 27A:
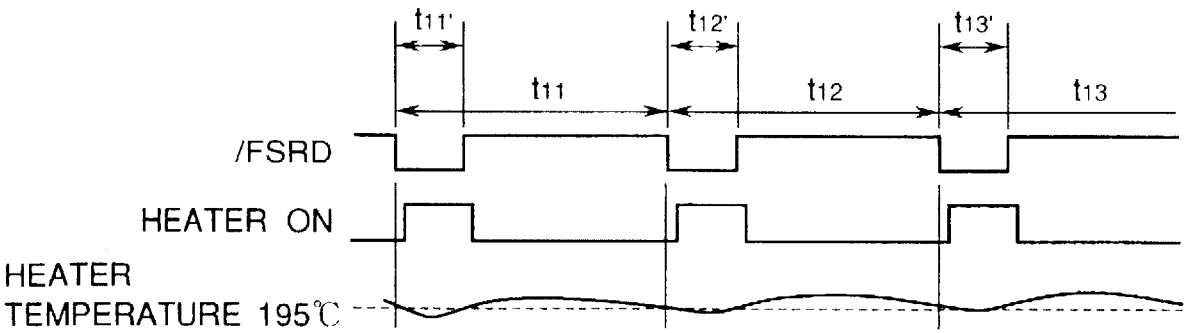
FIGS. 27A and 27B are timing charts which show a time during which electric power is supplied to a heating means in Embodiment 7 of the present invention.
Figure 27B:
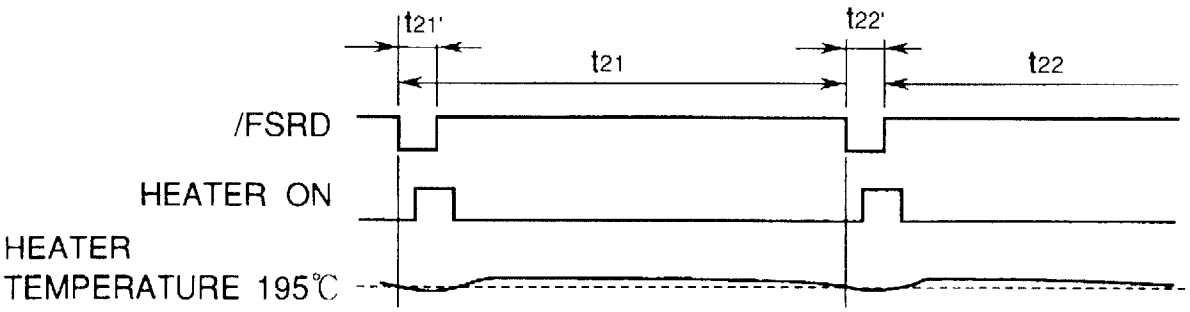

FIGS. 27A and 27B show the timing chart of the temperature control performed by the engine control unit 101. FIG. 27A shows a case wherein the control is carried out based on the 195° C. fixing temperature for thick paper, while FIG. 27B shows a case wherein the control is carried out based on the 195° C. fixing temperature for standard paper.

The zero cross control of a heater ON signal is implemented by the SSR driving circuit SSRD shown in FIG. 9 and therefore it is rendered active later than a heater driving signal /FSRD.

As it is understood from FIGS. 27A and 27B, if standard paper is used with the fixing temperature set to 195° C., the heater ON time shortens because less heat is absorbed by the paper. The same phenomenon applies to a case wherein the fixing temperature is set to 195° C. under the high-temperature environment.

If the fixing operation is continued with the standard paper or under the high-temperature environment with the fixing temperature set at 195° C., it would be problematic in the aspect of a rising temperature in the apparatus and energy consumption.

To avoid such a problem, the present invention measures and compares the driving time of the aforesaid heater to detect such a state and switch the fixing temperature to 185° C.

In this case, there are at least the following two methods for measuring the driving time, i.e., the quantity of supplied electric power, of the fixing heater. These methods may be used separately or in combination for the measurement.

The first method measures an interval time of the driving signal. In FIG. 27A, the interval time is denoted by $t_{11}$, $t_{12}$ and $t_{13}$.

The second method measures the ON duration itself of the driving signal. In FIG. 27A, the ON duration is denoted by $t_{11}$, $t_{12}$ and $t_{13}$.

A point at which the measurement is started may be the central part of recording paper or may be sampled all over the paper. It is of course possible to perform the measurement all over the paper depending on a processing capacity of a CPU or a memory condition of the engine control unit.

Such measurement automatically means indirect measurement of the thickness and heat capacity of the paper provided that the environmental temperature stays constant.

Subsequently, the measurements thus obtained are stored in a register E to determine a mean value and store the mean value in memory. In this embodiment, the mean value is obtained, but a maximum or minimum value may be used instead.

If the next print request has been received, then it is determined again whether the mode is the normal mode. If the mode is found to be the manual mode, then a mean value of the measurements, which are obtained by measuring the driving time in the same manner as described above, is determined and the mean value is stored in a register F, thus storing it in memory. In this embodiment, the method, wherein the interval time of the driving signal is measured as described above, was used.

The contents of the register values E and F thus measured are compared; if E<F, then the state shown in FIG. 27B is considered and therefore the fixing temperature is set to 185° C.; or if E≧F, then the fixing temperature is set to 195° C.

For the purpose of comparative operation, comparison based on equality signs was implemented. If, however, variations are observed between the two, comparative operation taking such variations into account should be implemented.

As discussed above, according to the present invention, by selecting the manual mode, it has become possible to set a fixing temperature suited for thick recording paper and also to automatically switch the temperature control mode of the fixing device to the normal mode when standard recording paper is used or under a high-temperature environment. Furthermore, in the past, the mode used to be somewhat forcibly switched to the normal mode in order to maximize the service life of a mechanical component, in particular, of a fixing heater unit. This caused inconvenience in that the mode was forcibly shifted to the normal mode while the user intended to print in the manual mode, making it necessary to set the mode back to the manual mode. Such inconvenience, however, has been eliminated by the present invention.

[EMBODIMENT 8]

Embodiment 8 of the present invention will now be described with reference to FIG. 28. Any sections that are common to those of Embodiment 7 will be given the same reference numerals, with the explanation thereof being omitted.

In this embodiment, a method, whereby the manual mode or the normal mode is set fully automatically from the driving time of the fixing heater, will be described.

The basic operation is the same as that of Embodiment 7; therefore, only different points will be discussed.

Figure 28:
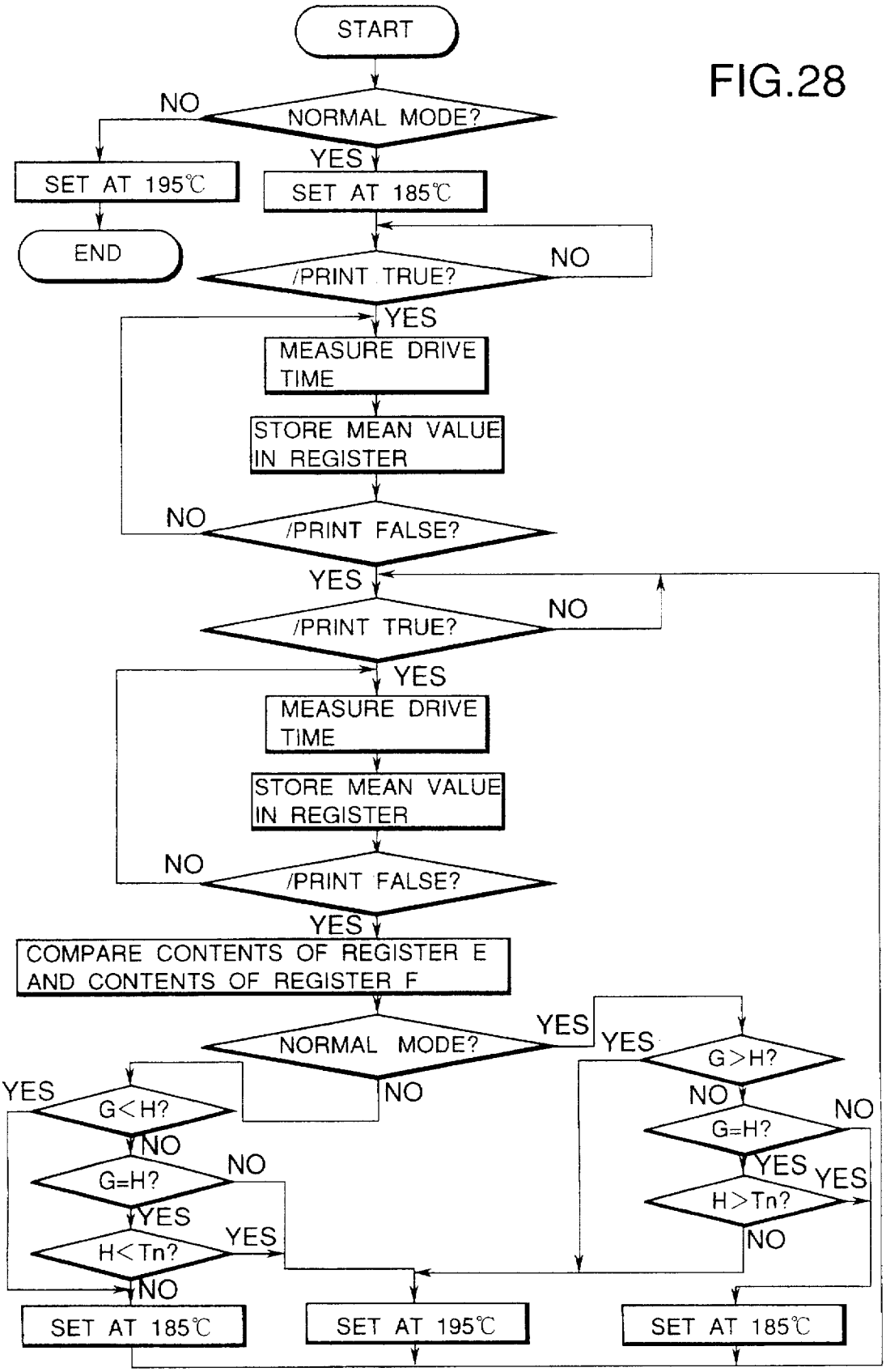
FIG. 28 is a flowchart of temperature control in Embodiment 8 of the present invention.

FIG. 28 is the flowchart which shows the operation of this embodiment. First, when the electric power is turned ON, either the manual mode or the normal mode is selected. Then, the driving time of the fixing heater is measured in the same manner as described above and a current driving time G is compared with a next driving time H. This method applies to the following cases:

In the first case, the preceding fixing operation is performed using thick paper in the manual mode for recording on thick paper and the following fixing operation is performed with thin paper in the manual mode. In this case, H is greater than G and the fixing temperature is set to 185° C.

In the second case, the preceding fixing operation is performed using thin paper in the manual mode for recording on thick paper and the following fixing operation is performed with thick paper in the manual mode. In this case, H is smaller than G and the fixing temperature is set to 195° C.

In the third case, the preceding fixing operation is performed using thick paper in the manual mode for recording on thick paper and the following fixing operation is performed also with thick paper in the manual mode, and in the fourth case, thin paper is used in the manual mode in both preceding and following fixing operations. In both cases, G and H are equal, but the fixing temperature must be set to 195° C. in the third case and 185° C. in the fourth case.

Accordingly, it was decided to compare H with a preset standard value to distinguish the third case from the fourth case. More specifically, an interval time $T_{22}$ obtained when thin paper is used at 195° C. is taken as a reference value. The reference value is compared with H and if they are equal, then it is determined as the fourth case and the temperature is set to 185° C.; if they are not equal ($H<T_{22}$), then it is determined as the third case and the temperature is set to 195° C.

In the fifth case, the preceding fixing operation is performed using thin paper in the normal mode for thin paper recording and the subsequent fixing operation is performed using thick paper in the normal mode. In this case, H is smaller than G and the fixing temperature is set to 195° C.

In the sixth case, the preceding fixing operation is performed using thick paper in the normal mode for thin paper recording and the subsequent fixing operation is performed using thin paper in the normal mode. In this case, H is greater than G and the fixing temperature is set to 185° C.

In the seventh case, the preceding fixing operation is performed using thin paper in the normal mode for thin paper recording and the subsequent fixing operation is performed also using thin paper in the normal mode, and in the eighth case, thick paper is used in the normal mode for both preceding and following fixing operations. In both cases, G and H are equal, but the fixing temperature must be set to 185° C. for the seventh case and to 195° C. for the eighth case.

Therefore, it was decided to compare a preset reference value with H in the same manner as that used for distinguishing the third case from the fourth case. More specifically, an interval time $T_{11}$ obtained when thick paper is used at 185° C. is taken as a reference value. The reference value is compared with H and if they are nearly equal, then it is determined as the eighth case and the temperature is set to 195° C.; if they are not equal ($H>T_{11}$), then it is determined as the seventh case and the temperature is set to 185° C.

The values of $T_{11}$ and $T_{22}$ have an allowance of approximately ±(0.5~1.5) sec. because of a characteristic of a mechanical configuration.

As explained above, according to the first invention of the present application, the fixing temperature is switched by transmitting the command to the engine control unit via a video interface communication means, making it possible to produce high-quality images with a stable fixing property even with thick paper such as bond paper without leading to higher cost compared with the conventional image forming apparatus.

In addition, if the fixing temperature is set higher than the normal fixing temperature, then it is set back to the normal fixing temperature under the predetermined conditions; therefore, the service life of the fixing roller and the like is not adversely affected. This is achieved only by adding software, thus avoiding increased cost.

The high-temperature control is carried out only for the fixing operation, wherein thick paper is used, and the control at the conventional fixing temperature is allowed for other cases. This enables energy saving without an increase in cost.

Further, according to the second invention of the present application, the fixing temperature is switched by transmitting the command to the engine control unit via the video interface communication means as in the first invention described above, the same effect as that in the first invention is obtained. In addition, the fixing temperature is properly switched by measuring and comparing the time of the supply of electric power to the heating means, allowing the fixing operation to be performed at a proper temperature in accordance with the recording material used or an ambient temperature.

[EMBODIMENT 9]

Figure 29:
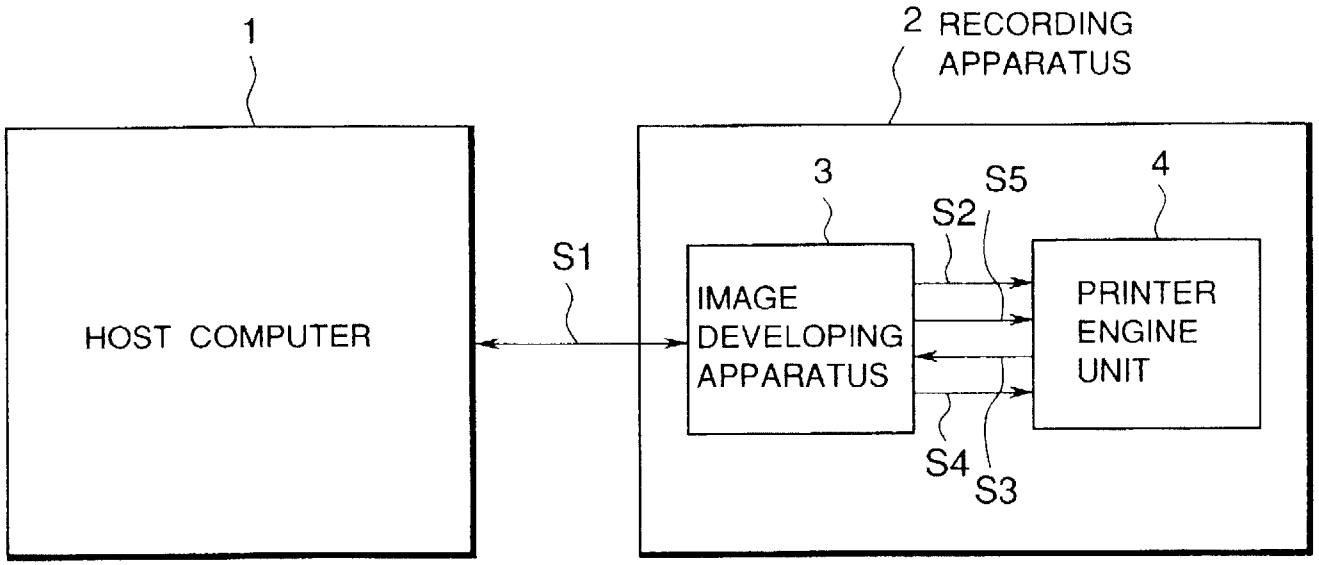
FIG. 29 is a block diagram which shows Embodiment 9.

FIG. 29 is the block diagram which shows the connection of the recording apparatus and the host computer of Embodiment 9 of the present invention. The sections, which have the same functions as those of the conventional example shown in FIG. 3, will be given the same symbols or reference numerals and the explanation thereof will be omitted.

In FIG. 29, S4 is a temperature control start instruction signal which is sent from the image developing apparatus 3 to the printer engine unit 4. The image developing apparatus 3 gives an instruction to begin controlling the fixing temperature to T2 without waiting for the completion of the development of print data from the host computer 1.

Figure 30:
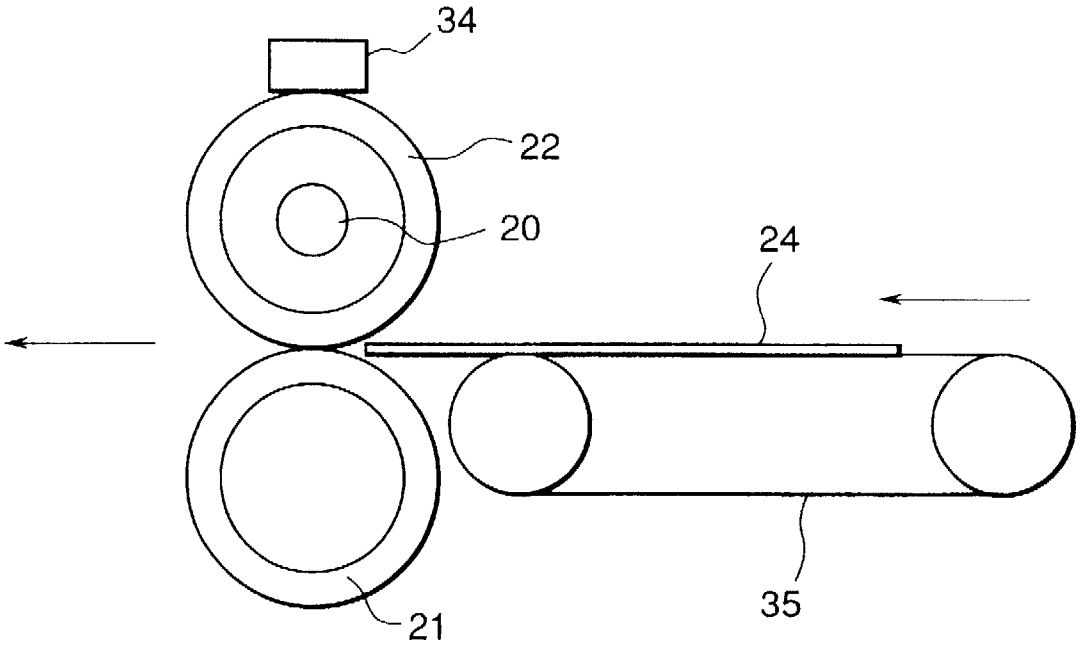
FIG. 30 is a schematic cross-sectional diagram which shows a configuration of a heating roller fixing device.

FIG. 30 is the schematic cross-sectional diagram which shows the configuration of the heat roller fixing device.

The heat roller fixing device is basically designed so that as soon as a halogen heater 20 is heated, a temperature control circuit, which will be discussed later, controls and maintains a heating roller 22 to and at a predetermined target temperature in accordance with the temperature data detected by a thermistor 34, and a recording material 24 is carried by a carrying belt 35 between the heating roller 22 and a pressure roller 23 pressed against the former, which are paired, thereby fixing the image.

Figure 31:
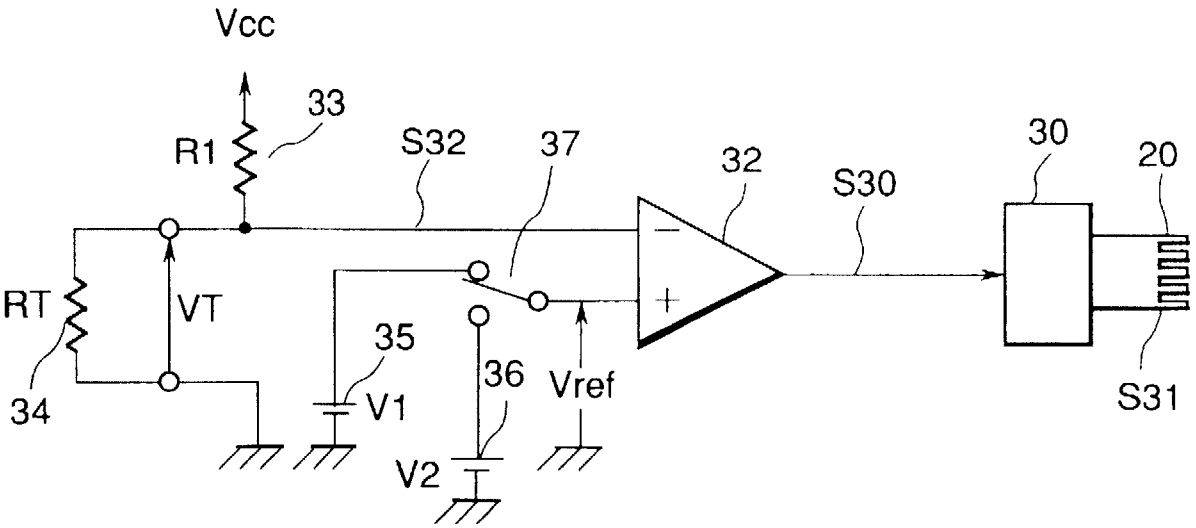
FIG. 31 is a block diagram which shows an example of a temperature control circuit.

FIG. 31 is a block diagram which shows an example of the temperature control circuit of the heat roller fixing device shown in FIG. 30.

The temperature control circuit has a halogen heater 31 provided inside the heating roller and a thermistor 34 provided on the surface of the heating roller. A comparator 32 compares a voltage Vt (=Rt/(R1+R2)×Vcc), which is obtained by a changing resistance of the thermistor 34, with the first control target voltage V1 or the second target voltage V2. And if the voltage Vt has not yet reached the first control target voltage V1 or the second target voltage V2, then an ON signal is issued. If the voltage Vt has reached the first control target voltage V1 or the second target voltage V2, then an OFF signal is issued.

A switching means 37 is a means for switching the control target voltage, the control voltage V1 corresponding to the standby temperature T1, and the control voltage V2 corresponding to the fixing temperature T2. A heater driving circuit 30 supplies an AC voltage S31 to the halogen heater 31.

Figure 32:
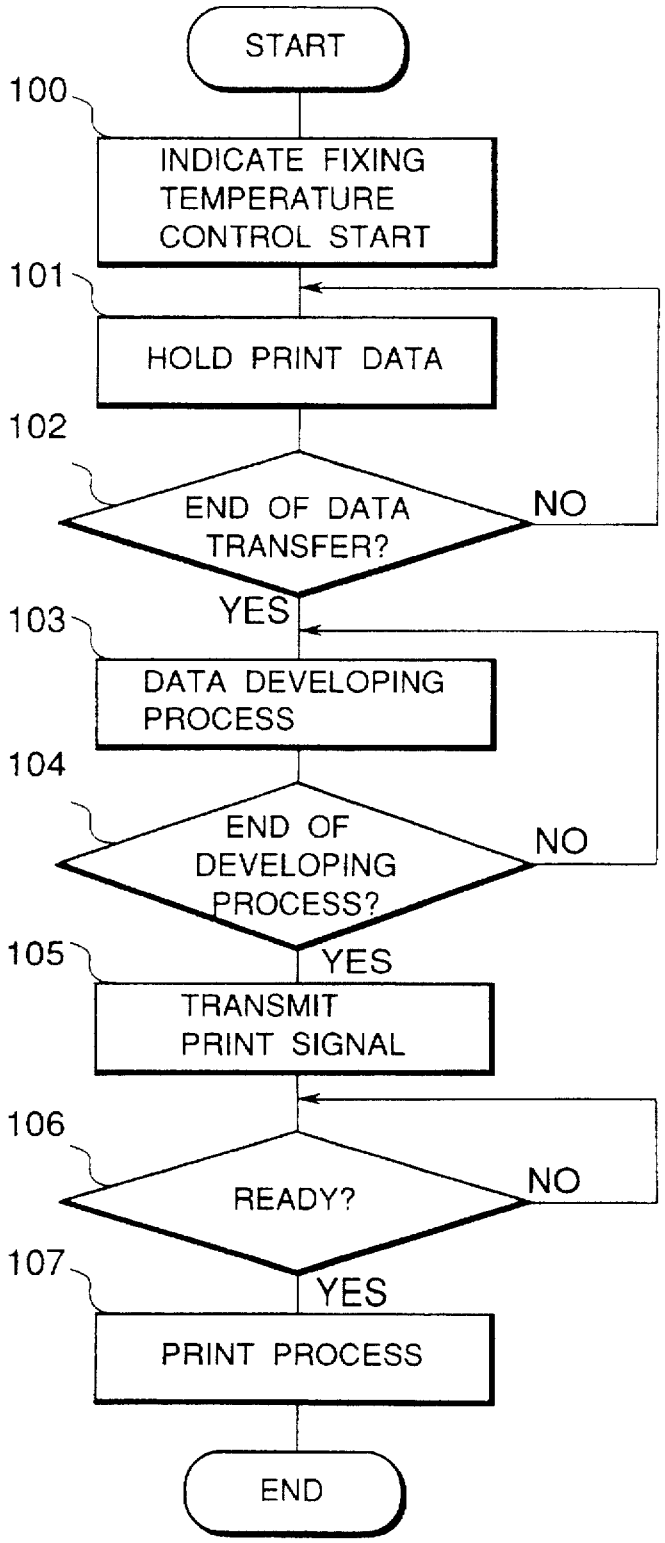
FIG. 32 is a flowchart which shows an operation of an image forming apparatus in Embodiment 1 described above.

FIG. 32 is the flowchart which illustrates the operation of the image developing apparatus 3 in Embodiment 1.

The image developing apparatus 3 instructs the temperature control circuit of the printer engine unit 4 to control the temperature to the fixing temperature T2 when the host computer 1 begins transferring print data (100). Then the print data is held in a memory, not shown, (101) until the transfer of the print data is completed (102).

When the transfer of the print data is completed (103), a data developing process is implemented until all the print data have been developed into bit serial data (104). Upon completion of the development (105), a PRINT signal (S5) is sent out to the printer engine unit 4 (106).

When the printer engine unit 4 receives the PRINT signal, it supplies the READY signal (S3) to the image developing apparatus 3 as soon as the temperature reaches the fixing temperature T2 in the aforesaid temperature control circuit which has already been performing the temperature control. The image developing apparatus 3 waits for the READY signal to be issued (107) and it outputs a bit serial signal S2 successively to the printer engine unit 4 in synchronization with the synchronizing signal, not shown, which is received from the printer engine unit 4 (108).

Figures 5A, 5B, 5C, 5D, 5E, 5F:
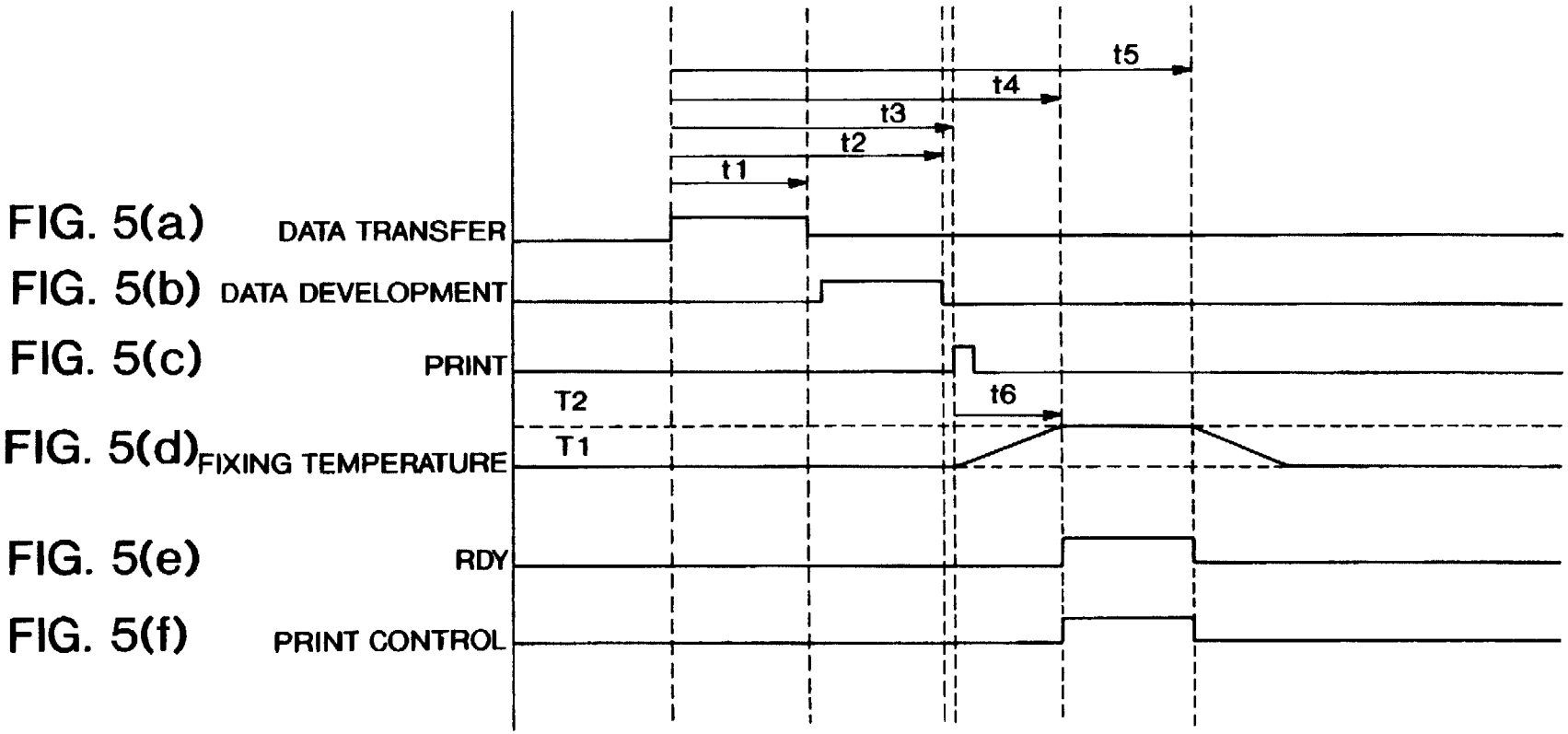
FIGS. 5(*a*)–(*f*) represent a timing chart which shows a relationship between the conventional data transfer and temperature control described above.
Figures 33A, 33B, 33C, 33D, 33E, 33F:
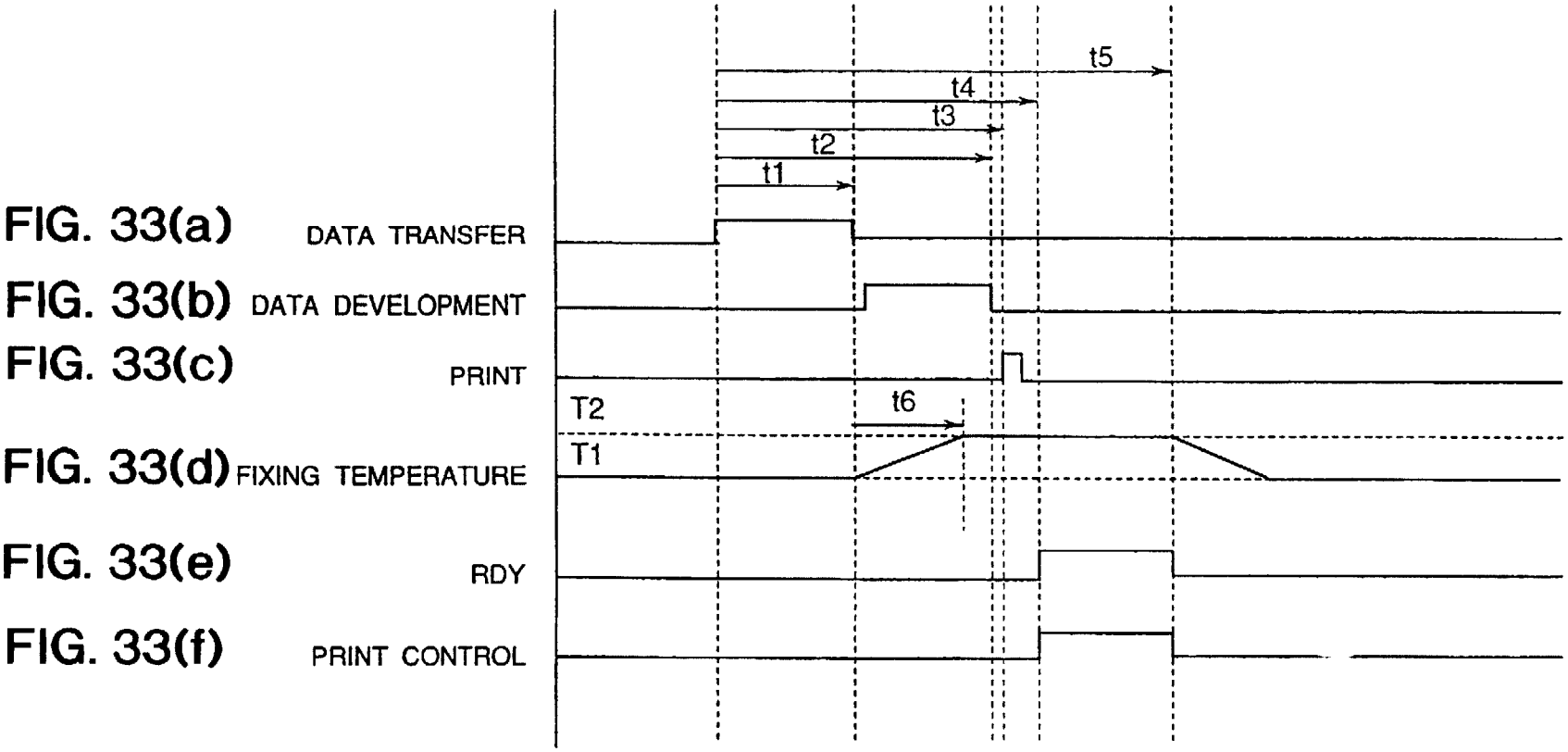
FIGS. 33(*a*)–(*f*) represent a timing chart which shows a relationship between data transfer and temperature control in Embodiment 1 described above.

Just as FIGS. 5(*a*)–(*f*) of the conventional example, FIGS. 33(*a*)–(*f*) represent a timing chart which shows the relationship between data transfer and temperature control. In the drawing, t1 is a time required by the host computer 1 to complete the transfer of the print data to the recording apparatus 2 via the communication line S1, and t2 is a time required by the image developing apparatus 3 to complete the development into the bit serial data.

Further, t3 is a time required for the PRINT signal S5 to be transmitted to the printer engine unit 4, and t4 is a time required for the fixing temperature to reach T2 and the READY signal S3 to be issued.

Furthermore, t5 is a time required for printing to be completed, and t6 is a time required for the temperature to rise from the standby temperature T1 to the fixing temperature T2. The time t6 overlaps with the data transfer; therefore, t5 is obviously shortened compared with the conventional example.

[EMBODIMENT 10]

Unlike Embodiment 9, wherein the instruction for starting the fixing temperature control is given to the printer engine unit 4 as soon as the data transfer begins, Embodiment 10 is designed to issue the instruction for starting the fixing temperature control after the data development.

In the following description of Embodiment 10, the explanation of the connection of the recording apparatus and the host computer will be omitted because it is the same as that of Embodiment 9. Additionally, the functions that are equivalent to those of the conventional example and Embodiment 9 are given the same symbols or reference numerals and the explanation thereof will be omitted.

Figure 34:
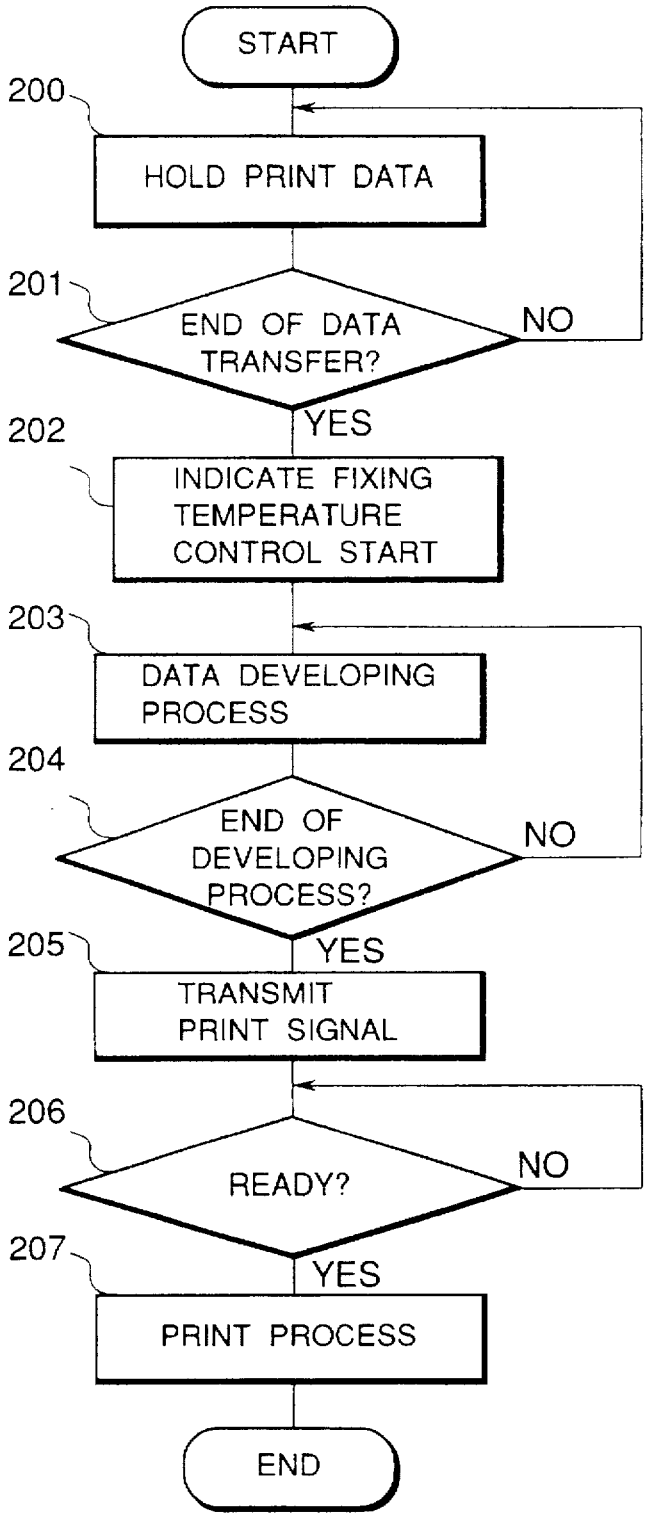
FIG. 34 is a timing chart which shows a relationship between data transfer and temperature control in Embodiment 2 described above.

FIG. 34 is the flowchart which illustrates the operation of the image developing apparatus 3 of Embodiment 10.

In the image developing apparatus 3, the print data are held in the memory which is not shown (200) until the transfer of the print data received from the host computer is completed (201). When the transfer of the print data is completed (201), the instruction for controlling the temperature to the fixing temperature T2 is given to the temperature control circuit of the printer engine unit 4 (202).

Then, the data developing process is implemented until all the print data are developed into the bit serial data (203). Upon completion of the developing process (204), the PRINT signal S5 is sent to the printer engine unit 4 (205).

When the printer engine unit 4 receives the PRINT signal S5, it outputs the READY signal S3 to the image developing apparatus 3 as soon as the temperature reaches the fixing temperature T2 in the aforesaid temperature control circuit which has already been carrying out the temperature control.

The image developing apparatus 3 waits for the READY signal S3 to be issued (206) and it outputs the bit serial signal S2 successively to the printer engine unit 4 in synchronization with the synchronizing signal, not shown, which is received from the printer engine unit 4 (207).

Figures 35A, 35B, 35C, 35D, 35E, 35F:
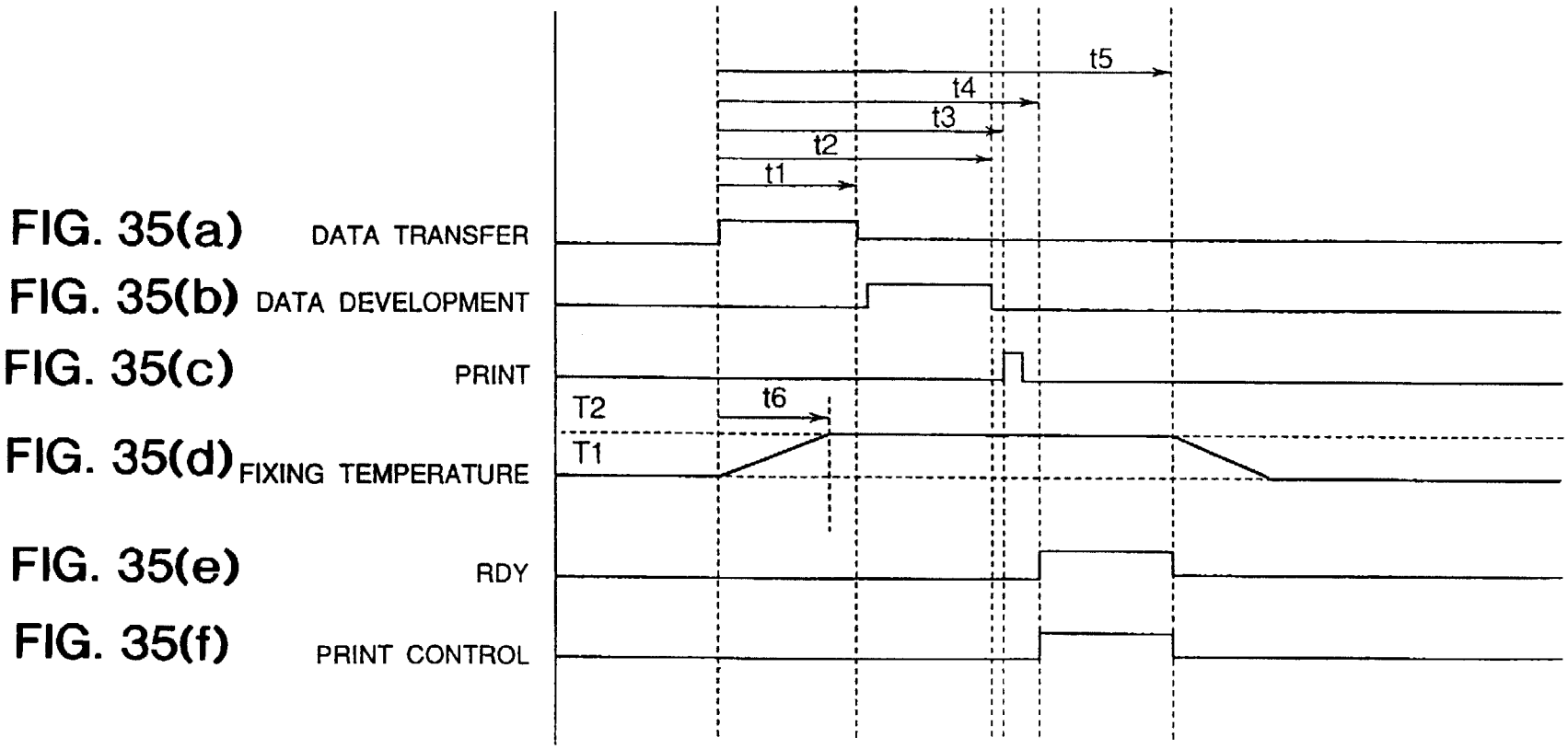
FIGS. 35(*a*)–(*f*) represent a flowchart which shows an operation of an image developing apparatus in Embodiment 2 of the present invention.

Just as FIGS. 5(*a*)–(*f*) of the conventional example, FIGS. 35(*a*)–(*f*) represent a timing chart which shows the relationship between data transfer and temperature control, t1 being the time required by the host computer 1 to complete the transfer of the print data to the recording apparatus 2 via the communication line S1, and t2 being the time required by the image developing apparatus 3 to complete the development into the bit serial data.

Further, t3 is the time required for the PRINT signal S5 to be transmitted to the printer engine unit 4, and t4 is the time required for the fixing temperature to reach T2 and the READY signal S3 to be issued.

Furthermore, t5 is the time required for printing to be completed, and t6 is the time required for the temperature to rise from the standby temperature T1 to the fixing temperature T2. The time t6 overlaps with the data transfer; therefore, t5 is obviously shortened compared with the conventional example.

[EMBODIMENT 11]

Unlike Embodiments 9 and 10 described above, wherein the instruction for starting the fixing temperature control is given to the printer engine unit 4 univocally after the completion of the data transfer or of the data development, Embodiment 11 has a data quantity counting means which is connected to the image developing apparatus 3 and the instruction for starting the fixing temperature control is given in accordance with a count value of the counting means.

Figure 36:
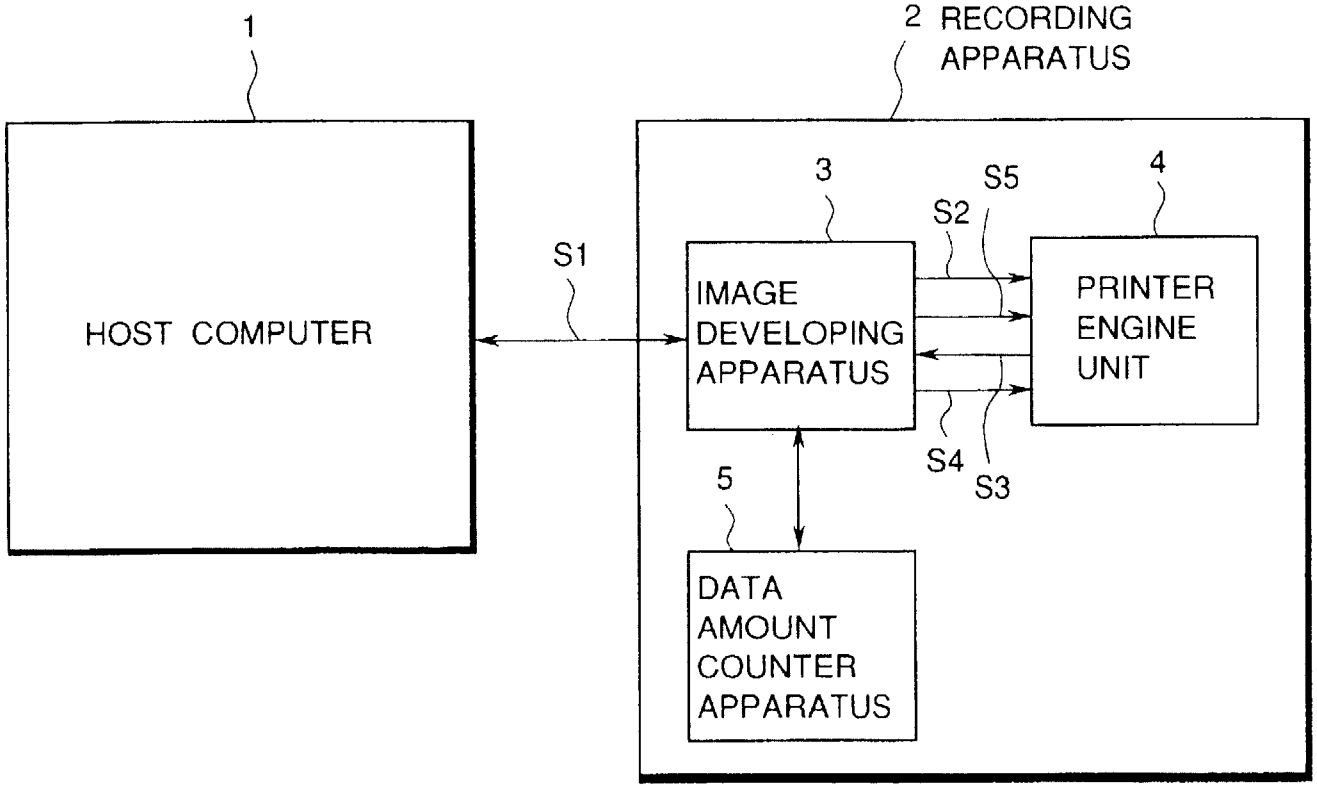
FIG. 36 is a block diagram which shows connection of the recording apparatus and the host computer of Embodiment 3 of the present invention.

FIG. 36 is the block diagram which shows the connection of the recording apparatus and the host computer in Embodiment 11 of the present invention. The functions that are equivalent to those of the conventional example and Embodiments 1 and 2 will be given the same symbols or reference numerals and the explanation thereof will be omitted.

In FIG. 36, the data quantity counting means 5 is designed to count the quantity of the print data received from the host computer 1 of the image developing apparatus 3 or the quantity of the serial bit data which are generated by developing the print data.

Figure 37:
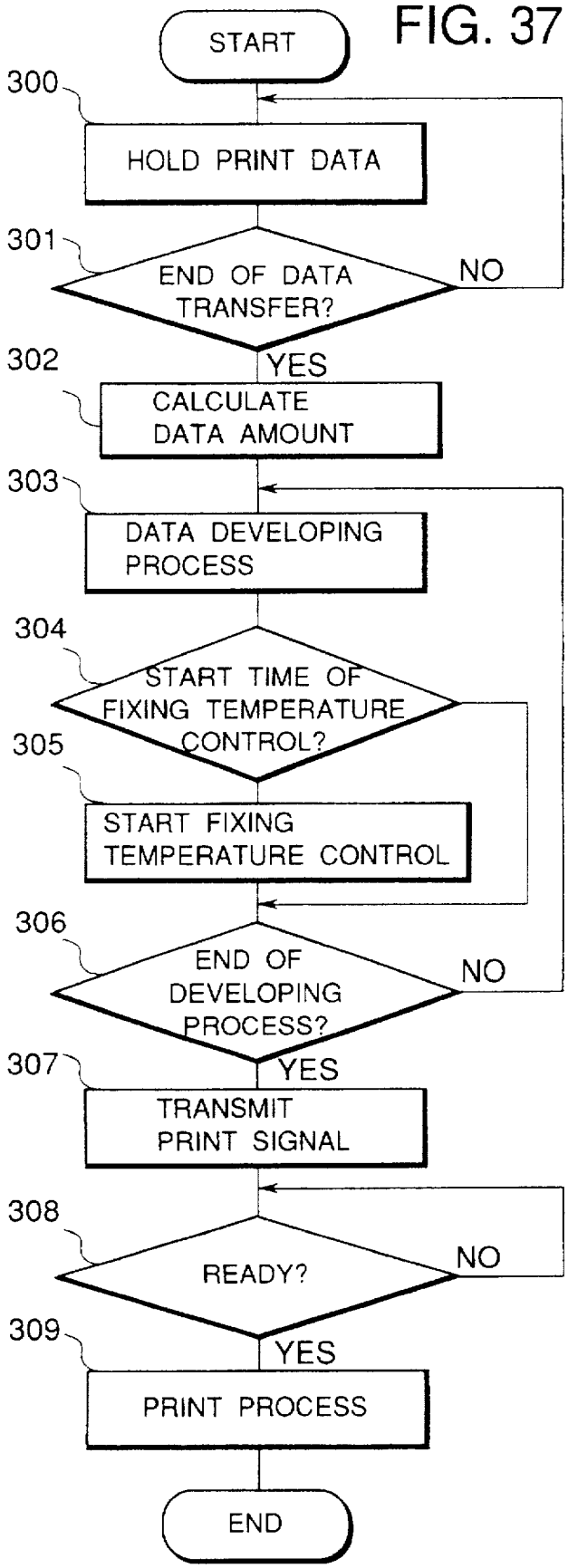
FIG. 37 is a flowchart which shows an operation of an image developing apparatus in Embodiment 3 described above.

FIG. 37 is the flowchart which illustrates the operation of the image developing apparatus 3.

In the image developing apparatus 3, the print data are held in the memory, not shown, (300) until the transfer of the print data from the host computer is completed (301). When the transfer of the print data is completed (301), an estimated value of the quantity of the serial bit data is calculated from the quantity of the print data by the data quantity counting means 5 and the result is held (302).

Then, the print data are developed (303) and when the development quantity of the serial bit data reaches the estimated value of the data quantity counting means 5 (304), the temperature control circuit of the printer engine unit 4 is given the instruction to control the temperature to the fixing temperature T2 (305). The data developing process is implemented until all the print data have been developed into bit serial data (303). Upon completion of the development (206), the PRINT signal S5 is sent out to the printer engine unit 4 (307).

When the printer engine unit 4 receives the PRINT signal S5, it supplies the READY signal S3 to the image developing apparatus 3 as soon as the temperature reaches the fixing temperature T2 in the aforesaid temperature control circuit which has already been performing the temperature control. The image developing apparatus 3 waits for the READY signal S3 to be issued (308) and it successively outputs the bit serial signal S2 to the printer engine unit 4 in synchronization with the synchronizing signal, not shown, which is received from the printer engine unit 4 (309).

Figures 38A, 38B, 38C, 38D, 38E, 38F:
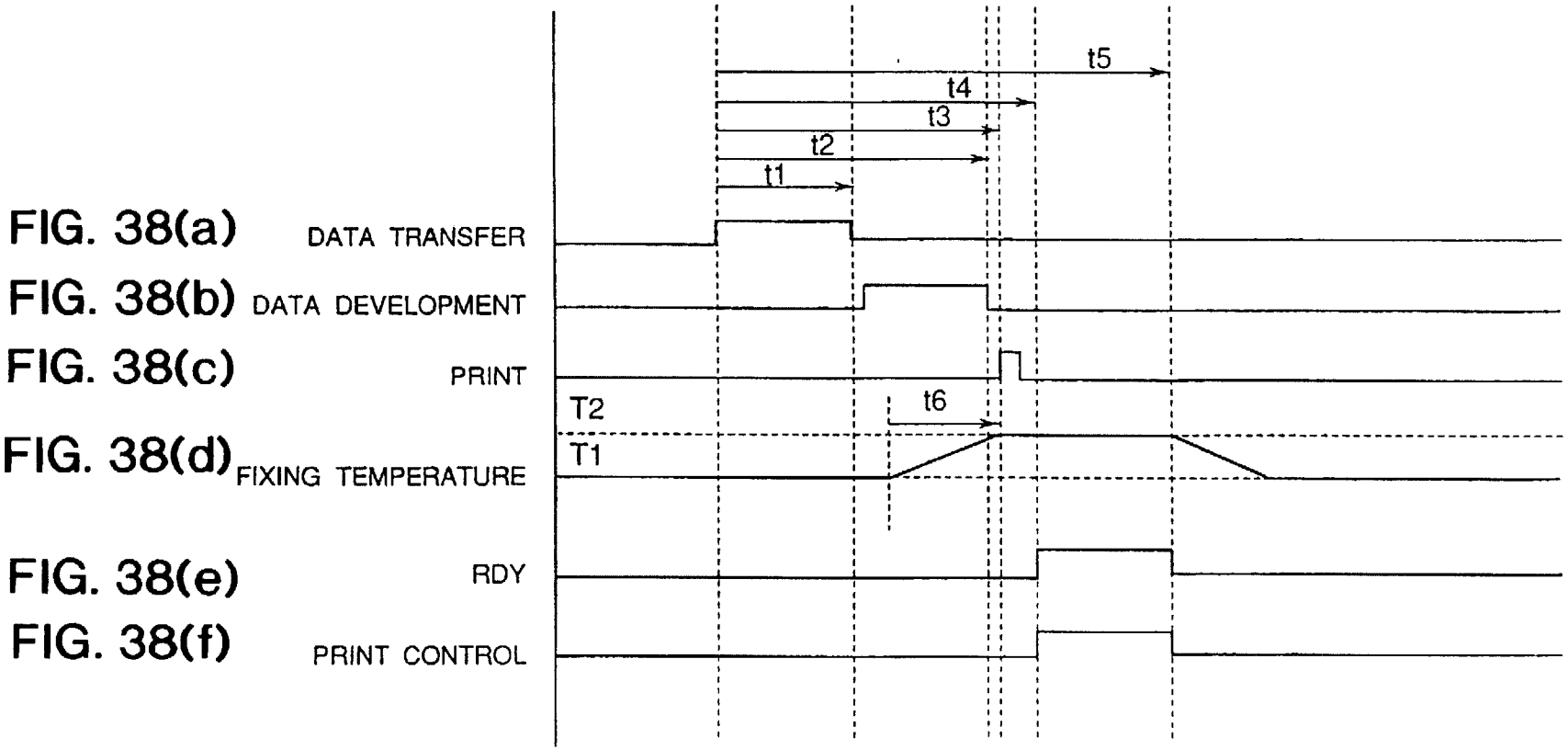
FIGS. 38(*a*)–(*f*) represent a timing chart which shows a relationship between data transfer and temperature control in Embodiment 3 described above.

Just as FIGS. 5(*a*)–(*f*) of the conventional example, FIGS. 38(*a*)–(*f*) represent a timing chart which shows the relationship between data transfer and temperature control.

In the drawing, t1 is the time required by the host computer 1 to complete the transfer of the print data to the recording apparatus 2 via the communication line S1, and t2 is the time required by the image developing apparatus 3 to complete the development into the bit serial data.

Further, t3 is the time required for the PRINT signal S5 to be transmitted to the printer engine unit 4, and t4 is the time required for the fixing temperature to reach T2 and the READY signal S3 to be issued.

Furthermore, t5 is the time required for printing to be completed, and t6 is the time required for the temperature to rise from the standby temperature T1 to the fixing temperature T2. The time t6 overlaps with the data development; therefore, t5 is obviously shorter than that in the conventional example.

As described above, according to the present invention, there is provided an effect that makes it possible to efficiently bring out the functions of the print engine in the recording apparatus at a minimum cost without the need of adding a new high-speed device because the temperature control of the heating roller can be started before the image development is completed and also makes it possible to achieve a higher printing speed than the conventional printing speed.

The description has been given to a case wherein the present invention is applied to the laser beam printer, however, the present invention can be suitably applied to any printer that employs a heat fixing device, namely, a printer using an LED, liquid crystal shutter or multi-stylus.

Further, the present invention permits any combinations of Embodiments 1 through 11 described above.

Furthermore, the present invention is not limited to Embodiments 1 through 11 described above, but may be available in diverse modifications within a range of the attached claims.

What is claimed is:

1. A method of controlling a fixing device in an apparatus, comprising the steps of:

selectively setting one of a plurality of fixing temperatures;

variably setting a time in accordance with an instruction;

controlling the electric power supplied to said fixing device so that a temperature of said fixing device is set to the fixing temperature set in said selective setting step in response to a command outputted from a data source prior to an image forming request;

controlling the electric power supplied to said fixing device so that the temperature of said fixing device is set to a standby temperature lower than the set fixing temperature in response to end of an image forming operation relating to an image forming request; and turning off the supplied power to said fixing device when the variably set time elapses after end of the image forming operation.

2. A method according to claim 1, wherein the fixing temperature is set in said selective setting step on the basis of a command sent out from a data source generating image information and/or an environmental condition of the apparatus.

3. A method according to claim 1, further comprising the step of variably setting the standby temperature, wherein the electric power supplied to said fixing device is controlled in said standby temperature control step so that said fixing device is set at the set standby temperature.

4. An image forming apparatus, comprising;

means for forming an image on a recording medium in accordance with image information received from a data source;

a fixing device for fixing the image formed on the recording medium:

means for selectively setting one of a plurality of fixing temperatures;

means for variably setting a time in accordance with an instruction;

control means for controlling the electric power supplied to said fixing device so that a temperature of said fixing device is set to the fixing temperature set by said selective setting means in response to a command outputted from the data source prior to an image forming request, for controlling the electric power supplied to said fixing device so that the temperature of said fixing device is set to a standby temperature lower than the set fixing temperature in response to an end of an image forming operation, and for turning off the supplied power to said fixing device when the variably set time elapses after an end of the image forming operation.

5. An image forming apparatus according to claim 4, wherein the fixing temperature is set by said selective setting means on the basis of the command outputted from the data source generating image information and/or an environmental condition of the apparatus.

6. An image forming apparatus according to claim 4, further comprising means for variably setting the standby temperature, wherein the electric power supplied to the fixing device is controlled by said means for variably setting the standby temperature so that the fixing device is set at the set standby temperature.

7. A temperature control apparatus of a fixing device of an image forming apparatus, comprising:

setting means for setting at least one of two modes including a first mode corresponding to a standard temperature and a second mode corresponding to a temperature higher than said standard temperature;

input means for inputting an instruction of the mode to be set;

determining means for determining whether a state of said image forming apparatus is in a predetermined condition; and control means for setting said first mode to said setting means without regard to whether the instruction for setting said second mode has been inputted when it has been determined that the state of said image forming apparatus is in the predetermined condition.

8. An apparatus according to claim 7, wherein the predetermined condition is that an image forming operation in the second mode has been ended.

9. An apparatus according to claim 7, wherein the predetermined condition is that paper feeding means to which a recording medium is to be fed has been changed after the setting of the second mode.

10. An apparatus according to claim 7, wherein the predetermined condition is that it has been detected that there is no paper in a paper feeding means, after the setting of the second mode.

11. An apparatus according to claim 7, wherein the predetermined condition is that a size of a recording medium to be fed has been changed after the setting of the second mode.

12. A temperature control method for control of a fixing device of an image forming apparatus, comprising:

setting at least one of two modes including a first mode corresponding to a standard temperature and a second mode corresponding to a temperature higher than said standard temperature;

inputting an instruction of the mode to be set;

determining whether a state of said image forming apparatus is in a predetermined condition; and setting said first mode without regard to whether the instruction for setting said second mode has been inputted when it has been determined that the state of said image forming apparatus is in the predetermined condition.

13. A method according to claim 12, wherein the predetermined condition is that an image forming operation in the second mode has been ended.

14. A method according to claim 12, wherein the predetermined condition is that paper feeding means to which a recording medium is to be fed has been changed after the setting of the second mode.

15. A method according to claim 12, wherein the predetermined condition is that it has been detected that there is no paper in a paper feeding means, after the setting of the second mode.

16. A method according to claim 12, wherein the predetermined condition is that a size of a recording medium to be fed has been changed after the setting of the second mode.

* * * * *